US008848488B2

(12) United States Patent
Calabrese

(10) Patent No.: US 8,848,488 B2
(45) Date of Patent: Sep. 30, 2014

(54) DUAL DISPLAY TIMEPIECE

(75) Inventor: Vincent Calabrese, Lausanne (CH)

(73) Assignee: Blancpain S.A., Le Brassus (CH)

( * ) Notice: Subject to any disclaimer, the term of this patent is extended or adjusted under 35 U.S.C. 154(b) by 472 days.

(21) Appl. No.: 13/186,968

(22) Filed: Jul. 20, 2011

(65) Prior Publication Data

US 2012/0020192 A1 Jan. 26, 2012

(30) Foreign Application Priority Data

Jul. 21, 2010 (EP) ..... 10170331

(51) Int. Cl.

| | |
|---|---|
| ***G04F 7/00*** | (2006.01) |
| ***G04B 19/22*** | (2006.01) |
| ***G04F 7/08*** | (2006.01) |
| ***G04B 19/23*** | (2006.01) |

(52) U.S. Cl.

CPC ..... *G04B 19/235* (2013.01); *G04F 7/0876* (2013.01); *G04F 7/0833* (2013.01); *G04F 7/0871* (2013.01); *G04F 7/0885* (2013.01); *G04F 7/0828* (2013.01)

USPC ..... 368/21; 368/80; 368/101; 368/106

(58) Field of Classification Search

USPC ..... 368/97, 101, 103, 106, 21, 22, 80

See application file for complete search history.

(56) References Cited

U.S. PATENT DOCUMENTS

| | | | | |
|---|---|---|---|---|
| 906,212 | A | 12/1908 | Fischer | |
| 7,029,169 | B2 * | 4/2006 | Takahashi et al. | 368/106 |
| 7,293,911 | B2 * | 11/2007 | Bonvin et al. | 368/97 |
| 2005/0249044 | A1 * | 11/2005 | Forsey et al. | 368/110 |
| 2008/0205200 | A1 | 8/2008 | Spode et al. | |
| 2008/0310257 | A1 | 12/2008 | Perret et al. | |
| 2009/0310445 | A1 * | 12/2009 | Laucella et al. | 368/113 |

FOREIGN PATENT DOCUMENTS

| | | | |
|---|---|---|---|
| CH | 693 155 | A5 | 3/2003 |
| EP | 1 136 894 | A1 | 9/2001 |
| EP | 1 791 043 | A1 | 5/2007 |
| EP | 1 959 317 | A1 | 8/2008 |
| EP | 2 136 271 | A1 | 12/2009 |
| FR | 2 141 900 | | 1/1973 |
| GB | 2 266 791 | A | 11/1993 |

OTHER PUBLICATIONS

European Search Report issued Feb. 7, 2011, in European Application No. 10 17 0331, filed Jul. 21, 2010 (with English Translation of Category of Cited Documents).

* cited by examiner

*Primary Examiner* — Vit W Miska

(74) *Attorney, Agent, or Firm* — Oblon, Spivak, McClellad, Maier & Neustadt, L.L.P.

(57) ABSTRACT

A timepiece mechanism for a secondary display of a first physical quantity, wherein a push-button activates first mechanism for the coupling/uncoupling of the secondary display to or from a movement including a first display, and a pivoting first physical quantity cannon-pinion heart, wherein the first mechanism controls the coupling/uncoupling to or from the movement. A second push-button controls the zero reset of the secondary display, by uncoupling the first coupling/uncoupling mechanism, and returning the heart-piece to the original position thereof. A second coupling/uncoupling control mechanism includes either a pivoting time zone wheel set including a friction wheel, meshing with the movement, and a time zone wheel which, when the wheel set is in the coupling position, drives a second physical quantity cannon-pinion heart and/or a third physical quantity cannon-pinion heart, the friction wheel and time zone wheel being coaxial and cooperating via friction; or an inter-time zone mechanism.

21 Claims, 22 Drawing Sheets

100
12
12A
13
14
30A
35
36
48
50
53
93
94
95
96
96A
97
97A
98
132
154
232
254
15

DUAL DISPLAY TIMEPIECE

This application claims priority from European Patent Application No. 10170331.2 filed Jul. 21, 2010, the entire disclosure of which is incorporated herein by reference.

FIELD OF THE INVENTION

The invention concerns a mechanism for the additional secondary display of a first physical quantity, which includes a first push-button arranged for activating control means of first means for coupling/uncoupling said secondary display to or from a movement including a first display. Said secondary display includes a pivoting, first physical quantity cannon-pinion heart, the coupling/uncoupling means of which is arranged for controlling the coupling/uncoupling to or from said movement, a second, zero reset push-button for resetting said secondary display, by uncoupling said coupling/uncoupling means, and by returning said cannon-pinion heart to the original position thereof.

The invention also concerns an additional mechanism arranged to be added to a timepiece having a single movement, a first display and a crown for at least adjusting, via a motion work, the hand-setting of said first display in a setting position.

The invention further concerns a multiple display module including at least one such additional, on demand display mechanism and/or at least one such additional mechanism, and at least one other display operationally connected to said additional, on demand display mechanism or to said additional mechanism.

The invention further concerns a timepiece having a single movement, a first display and a crown for adjusting, via a motion work, at least the hand-setting of said first display in a setting position.

The invention also concerns the field of timepieces having multiple displays. It more specifically concerns timepieces that have a chronograph function and/or a time zone function.

BACKGROUND OF THE INVENTION

On demand display mechanisms are uncommon and are always relatively complex.

CH Patent No. 693 155 in the name of Andreas Strehler discloses a mechanism for displaying several different physical quantities, using a coupling and differential gear. This device requires a certain thickness due to the existence of a planetary gear whose axis is perpendicular to the plate.

EP Patent No. 1 959 317 in the name of Maurice Lacroix SA proposes an on demand display device for displaying several data using a minimum number of hands. A switchable transmission mechanism includes a transmission pinion driven by a first wheel set to represent a first piece of information to be displayed. An element with a first fly-back heart is freely mounted on the transmission pinion, and driven, depending upon the particular case, either by the first wheel set or by a second wheel set to represent a second piece of information to be displayed. A second fly-back heart is secured to the transmission pinion which carries a freely mounted transmission wheel. This transmission wheel carries a first/second hammer pre-stressed by a first/second pre-stressed spring against the first/second heart.

A switching wheel, rotating on the periphery of the transmission wheel, carries a first/second cam acting on the first/second hammer so as to remove alternately the contact between the first/second hammer and the first/second heart, in order to switch the position of the transmission wheel according to the first/second piece of information to be displayed. An intermediate control wheel, freely mounted about the transmission pinion, is in mesh with the switching wheel and secured to a control wheel, controlled by a transmission mechanism control device.

In a first embodiment, the element including the first fly-back heart is a coupling disc freely mounted on the transmission pinion using a friction coupling, and driven by the first wheel set. Thus, the first heart represents the measured time, and the second heart mounted on the transmission pinion represents the current time. The coupling disc carries a reset heart via cooperation with a reset hammer. This coupling disc may be prevented from rotating by a chronograph control mechanism with a clamp for gripping or releasing each disc.

In a second embodiment, the element including the first fly-back heart is a wheel, freely mounted on the transmission pinion, and driven by the second wheel set. Thus, the first heart represents the second piece of information to be displayed, corresponding to the second wheel set, and the second heart, mounted on the transmission pinion, represents the first piece of information to be displayed, corresponding to the first wheel set.

This mechanism, applied to a chronograph, includes a first stop-start push-button, a second reset push-button, and a third switching push-button for switching the state of the transmission mechanism. This type of mechanism remains complex, and above all voluminous, and it is difficult to adapt to an existing movement, since it requires significant alterations, particular as regards the crown for the third push-button. It is difficult to adapt as an additional mechanism and it requires significant space in the thickness of the movement.

GB Patent No. 2 266 791 in the name of GEORGE DANIELS discloses an additional chronograph display mechanism, including a stop/start push-button and a reset push-button, wherein zero resetting is achieved via cooperation between a hammer and a cannon-pinion heart which is coupled or uncoupled by the stop/start push-button.

EP Patent No. 1 136 894 in the name of DUBOIS TECHNIQUE HORLOGERE discloses a fly-back mechanism with a dedicated push-button and a friction coupling. A second uncoupling mechanism uncouples the drive mechanism when the fly-back is reset, and when pressure is maintained on the push-button.

These high performance mechanisms are, however, quite complex and difficult to make and adjust.

SUMMARY OF THE INVENTION

The invention proposes to create a dual display timepiece mechanism, which incorporates a chronograph mechanism, with a dual time zone function and a fly-back function, for resetting a timing operation which is underway and instantly starting a new timing operation by applying pressure to and immediately releasing a reset push-button.

The invention also proposes to allow the hands to be set at any time, both of the main display and the additional display, regardless of whether or not the chronograph is operating.

The invention concerns a mechanism for the additional, secondary display of a first physical quantity, which includes a first push-button arranged for activating control means of first means for coupling/uncoupling said secondary display to or from a movement including a first display. Said secondary display includes a pivoting, first physical quantity cannon-pinion heart, the coupling/uncoupling means of which is arranged for controlling coupling/uncoupling to or from said movement, and a second, zero reset push-button for said secondary display for resetting said secondary display by uncoupling said coupling/uncoupling means, and by returning said cannon-pinion heart to the original position thereof. The invention is characterized in that it includes second coupling/uncoupling control means, which includes either a pivoting time zone wheel set, including a friction wheel meshing with said movement and a time zone wheel, which, when said time zone wheel set is in the coupling position, directly or indirectly drives a second physical quantity cannon-pinion heart, and/or a third physical quantity cannon-pinion heart, said friction and time zone wheels being coaxial and able to cooperate with each other via a friction coupling; or an inter-time zone mechanism carried by a control lever comprised in said control means of the first coupling/uncoupling means. Said inter-time zone mechanism is a coupling mechanism and includes a bottom wheel directly meshing with said movement, and a top wheel, which, when said inter-time zone mechanism is in the coupling position, is arranged for directly or indirectly driving at least said second physical quantity cannon-pinion heart, and/or said third physical quantity cannon-pinion heart.

According to a feature of the invention, said additional display mechanism forms an additional on demand display mechanism, forming at least said secondary display of at least a first physical quantity, for said movement for measuring and/or generating at least one physical quantity comprising said first display of at least one physical quantity, wherein said mechanism includes:

said first start-stop push-button, arranged for activating control means of first coupling/uncoupling means arranged for allowing or preventing the coupling of at least one display indicator of said secondary display to said movement;

said second push-button, arranged for activating means controlling the reset of said secondary display;

and, for driving a display indicator of said first physical quantity, said secondary display includes said first physical quantity cannon-pinion heart which has no toothing and is free to pivot about a pivot axis, and which includes a peripheral heart-piece arranged for cooperating with a hammer comprised in said mechanism for returning said heart-piece to the original position thereof;

said first coupling/uncoupling control means controlling the coupling or uncoupling respectively of said first physical quantity cannon-pinion heart relative to said movement;

said second push-button controlling the zero reset of said secondary display, both by controlling the uncoupling of said first coupling/uncoupling control means, and by returning said heart-piece of said first physical quantity cannon-pinion heart to the original position thereof, and said secondary display, which, for driving the display indicators of at least a second physical quantity and/or a third physical quantity, includes at least said second physical quantity cannon-pinion heart, and/or said third physical quantity cannon-pinion heart which are free to pivot independently of each other, and which respectively include peripheral heart-pieces each arranged to cooperate with a hammer comprised in said mechanism in order to return said heart-piece to an original position;

said first start-stop push-button which controls second coupling/uncoupling control means, arranged for allowing or preventing the coupling of at least said second physical quantity cannon-pinion heart and/or said third physical quantity cannon-pinion heart to said movement;

and said second push-button which controls the zero reset of said secondary display, by uncoupling said second coupling/uncoupling control means, and returning said heart-pieces to the original position thereof.

The invention further concerns a multiple display module including at least one such additional, on demand display mechanism and/or at least one such additional mechanism, and at least one other display operationally connected to said additional, on demand display mechanism or to said additional mechanism.

The invention further concerns a timepiece having a single movement, a first display and a crown for adjusting, via a motion work, at least the hand-setting of said first display in a setting position, characterized in that it includes at least one such additional, on demand display mechanism and/or at least one such additional mechanism, or at least one such multiple display module.

The invention does not include any brakes, and relies on a limited number of components.

BRIEF DESCRIPTION OF THE DRAWINGS

Other features and advantages of the invention will appear upon reading the following detailed description, with reference to the annexed drawings, in which:

FIGS. 6, 7 and 13 to 18 show schematic, perspective, partial views of a mechanism according to the invention, following the assembly sequence thereof, with FIGS. 6 to 15 and 18 more particularly illustrating a first coupling/uncoupling operation also called the start/stop operation, and FIGS. 16 and 17 illustrating a fly-back reset operation;

FIG. 8 shows a schematic perspective view of a time zone wheel set including a friction wheel, incorporated in the mechanism according to this first embodiment;

FIG. 10 shows a schematic, partial cross-section along a plane passing through the axis of the seconds pivot of the basic movement to which the mechanism of the invention is secured, which is shown with the secondary display thereof in the uncoupled position;

FIG. 11 shows the mechanism of FIG. 10, with said secondary display in a coupled position;

FIG. 12 shows a schematic, partial cross-sectional view, along a plane passing through the seconds pivot axis, of a detail of the cooperation between a chronograph control lever and a seconds heart-piece of the invention, in the position of FIG. 10;

FIGS. 19 and 20 show schematic, partial, plan views of the mechanism of FIGS. 6 to 18, respectively with the fly-back in the let down and wound position;

FIG. 21 shows a schematic, partial view of the kinematic chain of the mechanism of FIGS. 6 to 20, along a broken line section passing through the pivot axes of the various wheel sets shown therein;

FIGS. 22 and 23 show schematic, partial, respectively top and bottom plan views of the mechanism according to the invention, in a position where the crown of the movement is pushed in and hand-setting operations are impossible and where the coupling/uncoupling control device is in the coupled position;

FIGS. 24 and 25 show schematic, partial, respectively top and bottom plan views of the mechanism according to the invention, in a position where the crown of the movement is pulled out into a position where it is possible to set the hands of the secondary display, and where the coupling/uncoupling control device is in an uncoupled position;

FIG. 26 shows a schematic, cross-sectional view along a plane passing through the axis of the seconds pivot of the basic movement to which the mechanism according to the invention is secured, and through the axis of a column wheel comprised in said mechanism, of a detail of the kinematic chain for operating a chronograph control lever according to this second embodiment;

FIGS. 27 and 28 show schematic, perspective views of the mechanism of FIG. 26, in a position where a coupling mechanism, called an inter-time zone mechanism shown in schematic cross-section in FIG. 31, is in a coupled position;

FIGS. 29 and 30 show schematic, perspective views of the mechanism of FIG. 26, with the inter-time zone mechanism, shown in schematic cross-section in FIG. 31, in an uncoupled position;

FIG. 33 shows a schematic, perspective view of the mechanism of FIGS. 26 to 32, with the inter-time zone mechanism meshing with a time zone wheel set comprised in the mechanism;

FIG. 34 shows a schematic, perspective, overall view of the same mechanism, in an intermediate assembly position underneath a bridge of the chronograph arbour;

FIG. 35 shows a schematic, perspective, overall view of the same mechanism, in an intermediate assembly position with the chronograph hour and minute cannon-pinion hearts and a chronograph lever comprised in a fly-back mechanism according to the invention;

FIG. 36 shows a schematic, perspective view of the mechanism of FIG. 35 in an assembly position with the complete fly-back mechanism.

DETAILED DESCRIPTION OF PREFERRED EMBODIMENTS

Figure 3:
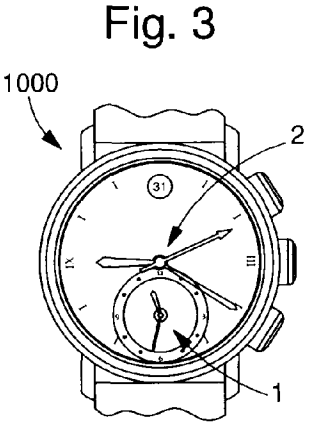
FIGS. 1 to 5 show schematic front views of timepieces incorporating a dual display according to the invention.
Figure 2:
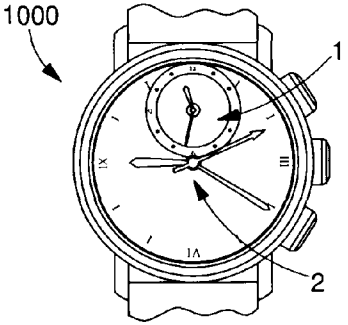
Figure 5:
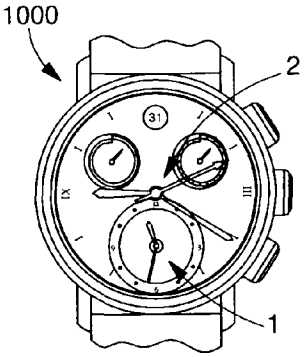
Figure 4:
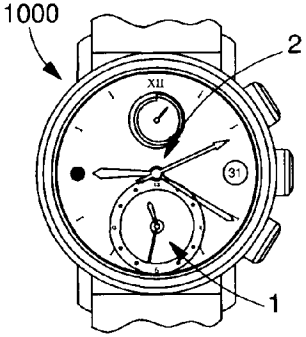
Figure 1:
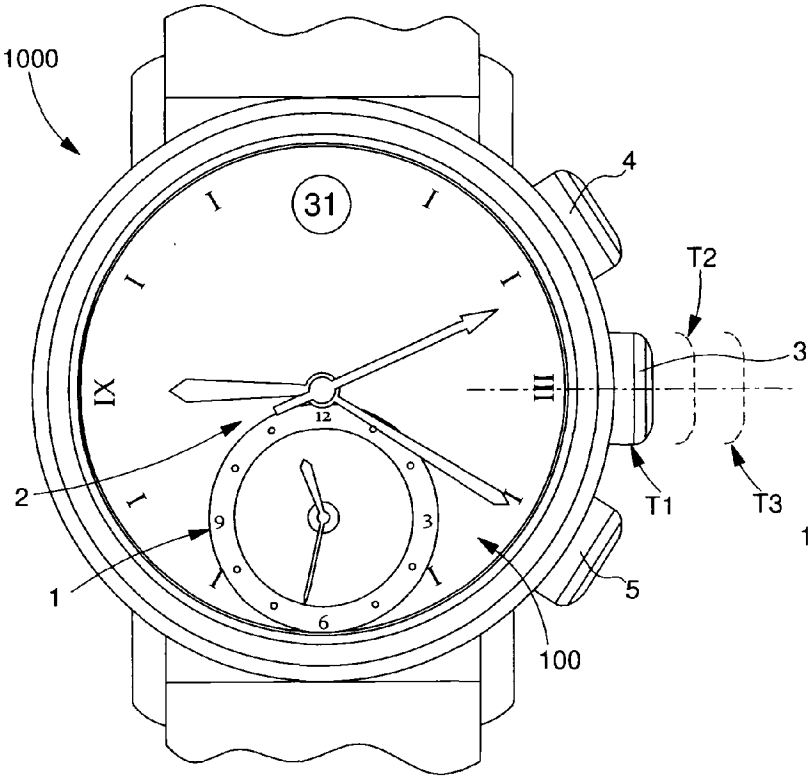

The invention also concerns the field of timepieces having multiple displays. It concerns more specifically timepieces that have a chronograph function.

The invention is devised to be adapted to an existing timepiece movement, on a plate or additional module. It may also be integrated in a movement.

It is an object of the invention to provide great ease of use, with the versatility of a secondary display with a reduced number of components and small thickness.

The invention concerns an additional, on demand display mechanism 100, forming at least a secondary display 2 for at least a first physical quantity, for a movement 6 measuring and/or generating at least one physical quantity. This movement 6 has a first display 1 of at least one physical quantity.

The additional, on demand display mechanism 100 includes:

a first start-stop push-button 4 arranged for activating control means of first coupling/uncoupling means arranged for allowing or preventing the coupling of at least one display indicator of said secondary display 2 to the movement 6. This first push-button 4 may consist of a push-button comprised in movement 6.

a second push-button 5, arranged for activating means controlling the reset of said secondary display 2. This second push-button 5 may consist of a push-button comprised in movement 6.

for driving a display indicator of the first physical quantity, this secondary display 2 includes a first physical quantity cannon-pinion heart 36, which preferably has no teeth and can pivot about a pivot axis. This cannon-pinion heart 3 includes a peripheral heart-piece 42 arranged for cooperating with a hammer of mechanism 100 for returning heart-piece 42 to the original position thereof.

the first coupling/uncoupling control means controls the coupling or uncoupling respectively of said first physical quantity cannon-pinion heart 36 relative to the movement 6;

the second push-button 5 controls the zero reset of said secondary display 2, by both uncoupling said first coupling-uncoupling control means, and by returning the heart-piece 42 of the first physical quantity cannon-pinion heart 36 to the original position thereof.

According to the invention, the additional, on demand display mechanism 100 includes second coupling/uncoupling control means which includes, either, in a first variant, a pivoting time zone wheel set 20, or, in a second variant, an inter-time zone mechanism 93.

In the first variant, the time zone wheel set 20 includes two coaxial wheels that can cooperate with each other via a friction coupling, namely a friction wheel 21 that meshes with movement 6 and a time zone wheel 25 which, when time zone wheel set 20 is in the coupled position, directly or indirectly drives a second physical quantity cannon-pinion heart 70, and/or a third physical quantity heart 80.

In the second variant, the inter-time zone mechanism 93 is carried by a control lever 132 comprised in the control means of the first coupling/uncoupling means. This inter-time zone mechanism 93 is a coupling mechanism. It includes a bottom wheel 98, directly meshing with movement 6, and a top wheel 96. When inter-time zone mechanism 93 is in the coupled position, top wheel 96 is arranged for directly or indirectly driving at least the second physical quantity cannon-pinion heart 70 and/or the third physical quantity cannon-pinion heart 80.

Preferably, mechanism 100 forms an additional display of several physical quantity, and:

for driving the first physical quantity display indicators, and display indicators for at least a second physical quantity and/or a third physical quantity, this secondary display 2 includes respectively said first physical quantity cannon-pinion heart 36 and at least a second physical quantity cannon-pinion heart 70 and/or a third physical quantity cannon-pinion heart 80, which can pivot independently of each other, and which respectively include peripheral heart-pieces 42, 72, 82. The latter are each arranged for cooperating each with a hammer comprised in mechanism 100 to return the heart-piece concerned to the original position thereof.

the first start-stop push-button 4 controls the second coupling/uncoupling control means, which are arranged for allowing or preventing the uncoupling of at least the second physical quantity cannon-pinion heart 70 and/or the third physical quantity cannon-pinion heart to the movement 6;

the second push-button 5 controls the zero reset of secondary display 2, by both uncoupling said second coupling-uncoupling control means, and returning said heart-pieces 42, 72, 82 to the original position thereof.

In a preferred embodiment, which will be described in more detail hereafter, the invention particularly concerns a dual display mechanism 100 for a timepiece 1000 with a movement 6, notably a single movement 6, the first display 1, also called the main display, being the continuous, normal time display mode, and secondary display 2 being an additional display.

Additional secondary display 2 may consist of a time display, a time zone display, a timer or programmer or timing device, chronograph or other device. The user is free to choose the application.

The secondary display 2 may be altered at any time, may be uncoupled on demand from the first display 1, and may be adjusted independently of first display 1.

In a particular, preferred application of the invention, secondary display 2 is connected to a chronograph function. In a particular application of the invention, this chronograph is coupled to a continuous hands-setting device by a crown 3. According to one feature of the invention, secondary display 2 can be manipulated while the chronograph is operating.

Preferably, the user may select whether to set the hands of first display 1 and/or secondary display 2, independently or simultaneously, by selecting a different traction position of crown 3.

Timepiece 1000 or mechanism 100 or the additional mechanism, includes a first push-button 4 with a start-stop function for starting or stopping secondary display 2, which is operational when crown 3 is pushed in. In the case of the chronograph function, this start-stop function concerns the three hour, minute and seconds hands of the secondary display 2. The first push-button 4 can be activated at any time.

A second push-button 5 is used for a "fly-back" function, for initialising or resetting all of the display members comprised in said secondary display 2 to zero, in particular, as described hereafter, the hour, minute and seconds hands thereof. If this operation is performed while the chronograph is operating, the three hands start again as soon as second push-button 5 is released. If this operation is performed when the chronograph is not operating, the three hands remain at zero. This second push-button 5 can be activated at any time, and it is operational whatever the position of crown 3.

Operations can be performed on crown 3 at any time, but they do not interrupt secondary display 2.

Crown 3 has several traction positions. The position in which the crown is completely pushed in will be called "T1", the intermediate position used for correcting secondary display 2 "T2", and the position in which the crown is completely pulled out for simultaneously setting the hands of the first display 1 and secondary display 2 "T3". In the present case, the additional display, and thus secondary display 2, is corrected in position T2.

A first intermediate traction position T2 is for setting the hands of secondary display 2, in both directions for the hours and minutes, without thereby altering first display 1. During this operation, the seconds hand of secondary display 2 remains where it was stopped when crown 3 was pulled out, if the chronograph is stopped. Otherwise the seconds hand will continue to turn. The same is true in traction position T3 of crown 3, unless the movement is fitted with a stop seconds system, which is not the case of the device presented in this description. This stop seconds system does not have any particular advantage in this case, and is in fact unnecessarily complex and cumbersome.

The completely pulled out position T3 allows simultaneous correction of first display 1 and secondary display 2, simultaneously and in both directions for the hours and minutes.

One important advantage of the invention is that it allows the use of an existing movement 6.

Indeed, the dual display mechanism 100 consumes very little power, corresponding only to the friction induced by the additional wheel sets used with respect to the basic movement.

Various options may be combined, as seen in FIGS. 1 to 5. For example: a secondary twenty-four hour display, day/night display, day of the week display, month display, date display, dates linked to the first and secondary display, the time zone display may be reversed between the first display and secondary display, angular position of secondary display 2. These options are in no way restrictive. The mechanism according to the invention uses a reduced number of components, occupies very little volume, so that it is relatively easy to integrate other additional complications.

It is also possible to position a date correction device under a horn, to prevent any inadvertent operation thereof.

The display, particularly secondary display 2, must be able to be set in both directions, in particular for the timer function.

The embodiment of the invention is described here in a non-restrictive manner on the basis of an existing movement 6. This description concerns the example of adaptation to an "ETA 2892" movement. The movement is preferably adapted by placing an additional stage 7, preferably supported by an additional support plate 8.

FIGS. 6 to 25 illustrate a first embodiment, described hereafter.

According to the invention, in this first embodiment, the second coupling/uncoupling control means includes a time zone wheel set 20 which can pivot and which includes two coaxial wheels arranged to cooperate in friction with each other, namely a friction wheel 21 directly meshing with said movement 6 and a time zone wheel 25. When time zone wheel set 20 is in the coupled position, this time zone wheel 25 is arranged to drive directly or indirectly at least the second physical quantity cannon-pinion heart 70 and/or the third physical quantity cannon-pinion heart 80.

Figure 6:
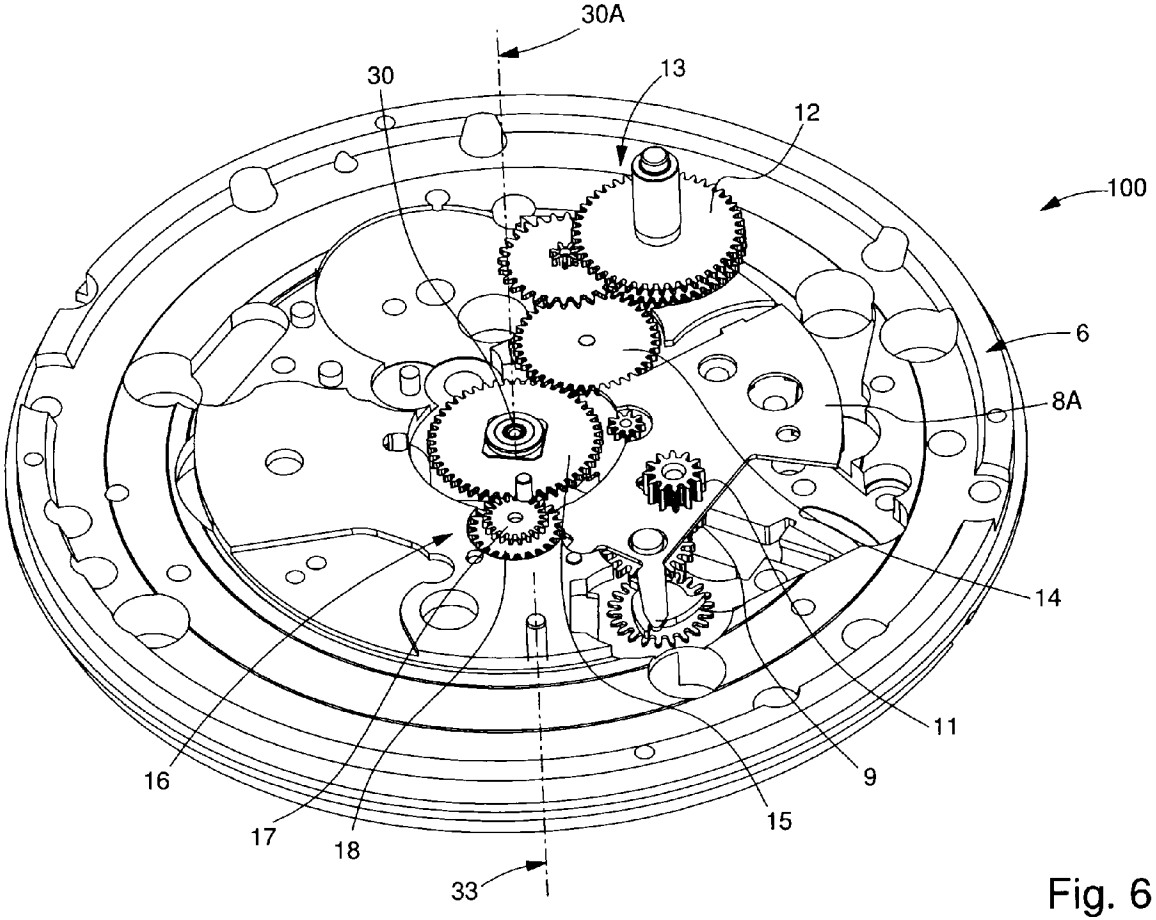
FIGS. 6 to 25 illustrate a first embodiment.

As seen in FIG. 6, the basic movement 6 includes an intermediate set-hands wheel 9, which meshes with the castle wheel of movement 6, and is extended towards top stage 7 on the other side of a motion work bridge 8A, by a set-hands extension pinion 11. Depending upon the position of crown 3, this extension pinion 11 may or may not cooperate with an intermediate wheel set 62, which will be explained hereafter.

Movement 6 includes an hour wheel 12, which can be adjusted by a preferably off-centre motion work 13, which meshes, via an intermediate gear train 14, with a minute wheel 15 which makes one revolution per hour. The hour wheel 12 is held on the plate of movement 6 via a plate 12A.

This minute wheel 15 meshes with a reduction stage, in the form of an intermediate reducing gear 16 including two stages 17 and 18, as seen in FIG. 6. The top stage 17 cooperates with the bottom part of a time zone wheel set 20, shown in FIG. 8, in particular with the toothing 29 of a friction wheel 21 in a particular embodiment of said time zone wheel set 20. The bottom stage 18 meshes with the minute wheel 15.

According to the invention, this friction wheel 21 is supported, by a friction mechanism in the form of a clamp 22 and/or a friction surface, on the bottom arbour 26 of the time zone wheel set 20 and/or on a bottom surface 24 of time zone wheel 25, when time zone wheel set 20 is in a median position. The function of the friction wheel set formed by friction wheel 21 and time zone wheel 25 is to uncouple time zone wheel 25 from friction wheel 21, so as to form an additional cannon-pinion which can be uncoupled to operate secondary display 2 alone, since the friction is controlled by an intermediate wheel 62 which meshes with time zone wheel 25 and which, in turn, is or is not operated by a set-hands extension pinion 11 extending a set-hands pinion 9, arranged for cooperating with movement 6, or comprised in movement 6.

Figure 8:
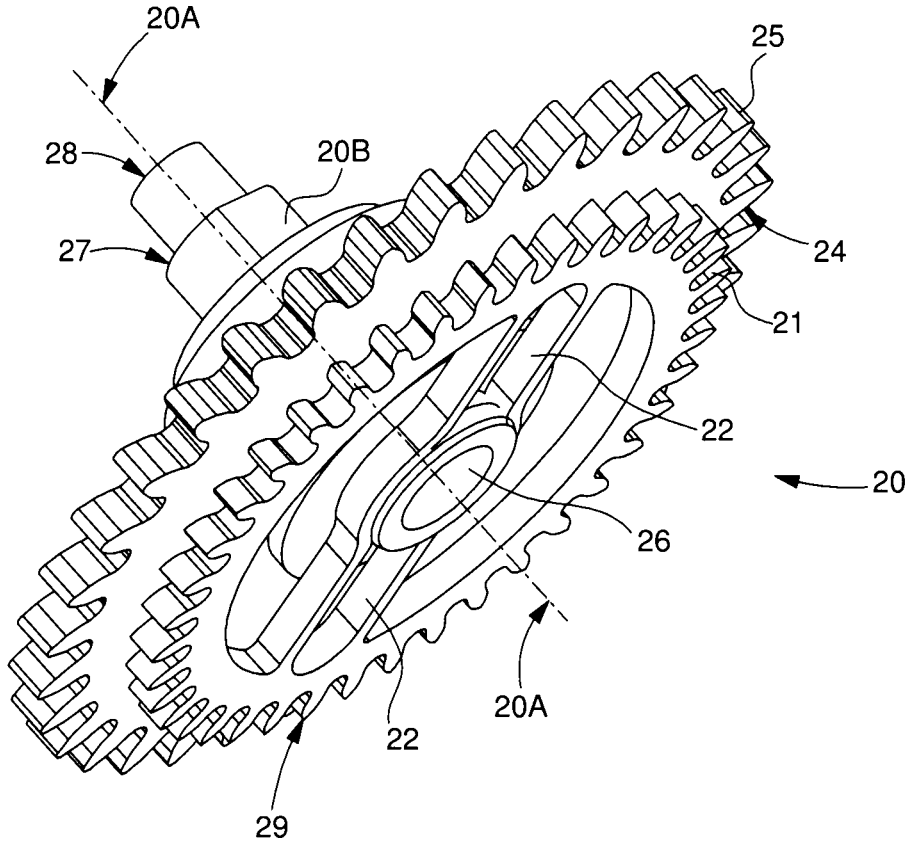

The time zone wheel set 20 is a staged wheel set of axis 20A as seen in FIG. 8. According to the invention, the bottom part, formed by a friction wheel 21, is supported, via the friction mechanism thereof in the form of a clamp 22 and/or a friction surface, on the bottom arbour 26 of said time zone wheel set 20 and/or on a bottom surface 24 comprised in a time zone wheel 25, when time zone wheel set 20, which is coaxial to friction wheel 21, is in the median position. Preferably, the friction occurs at clamp 22 on arbour 26. Time zone wheel set 20 includes, on the opposite side to friction wheel 21 relative to time zone wheel 25, a support surface 27 in proximity to the top end 28 of said wheel set 20.

Figure 21:
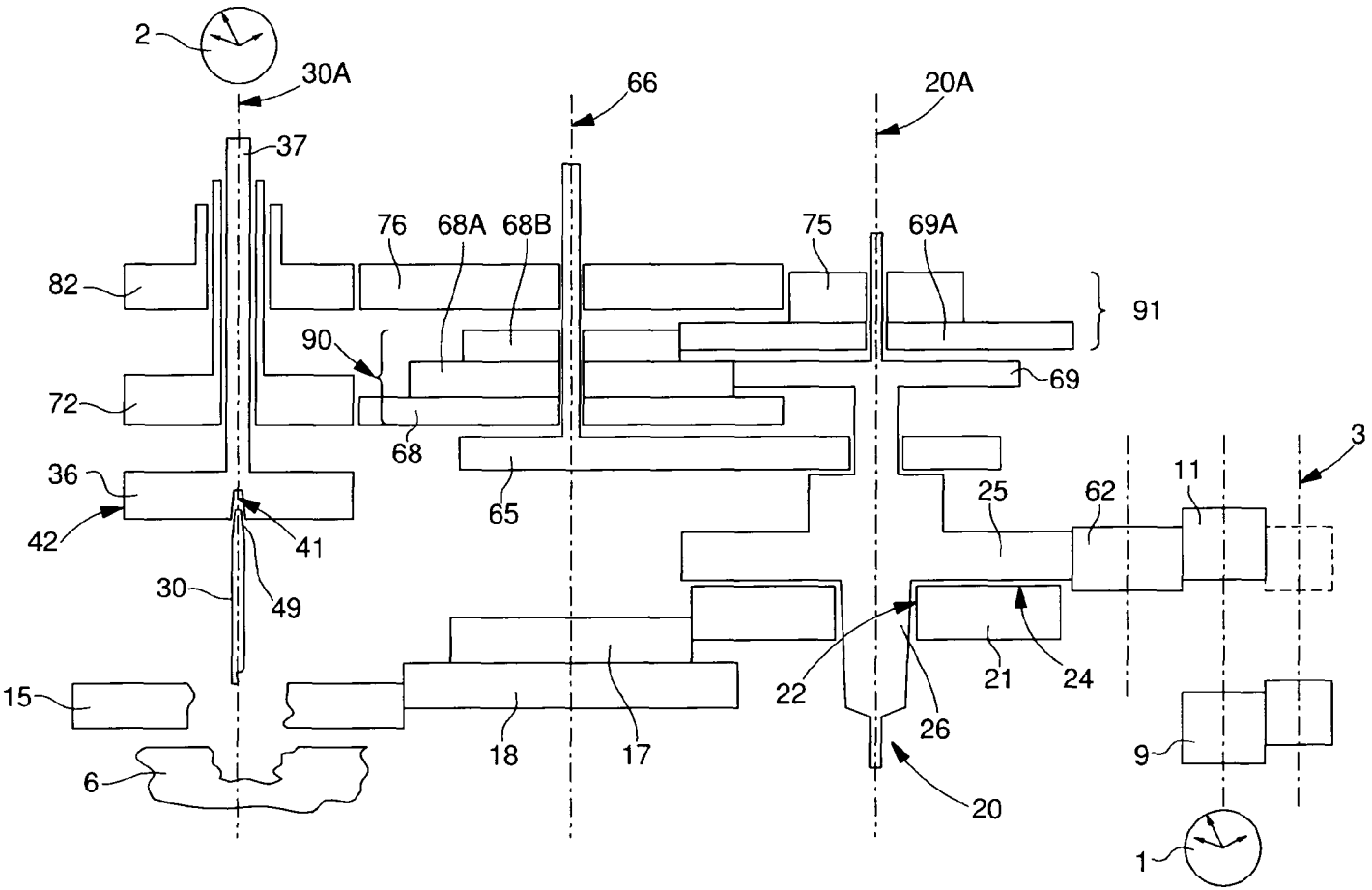
Figure 24:
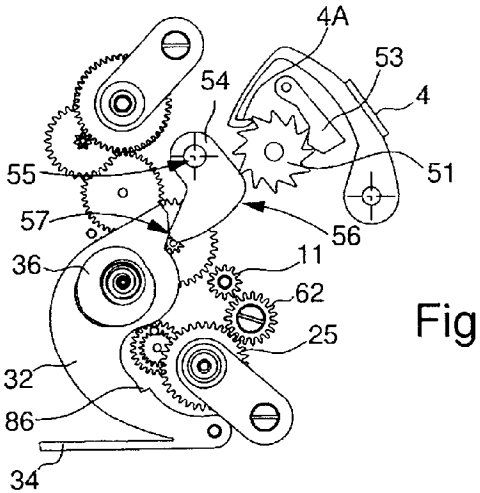
Figure 25:
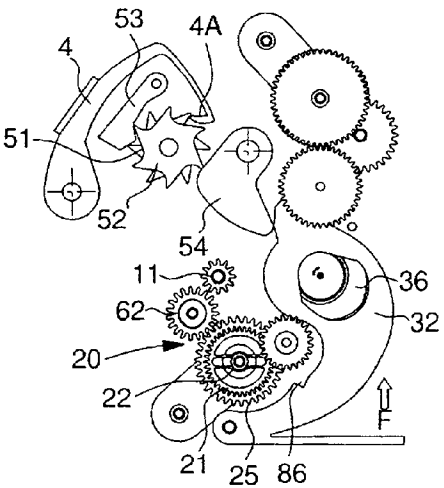
Figure 22:
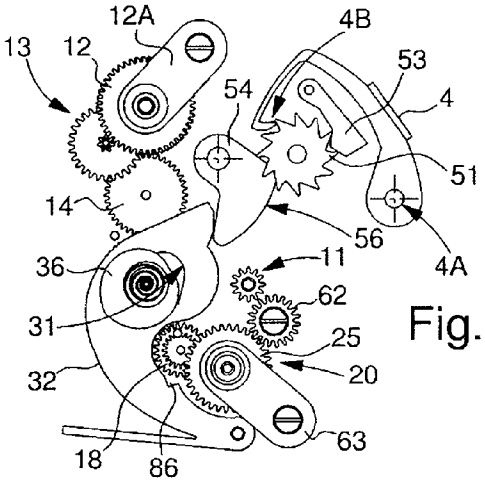
Figure 23:
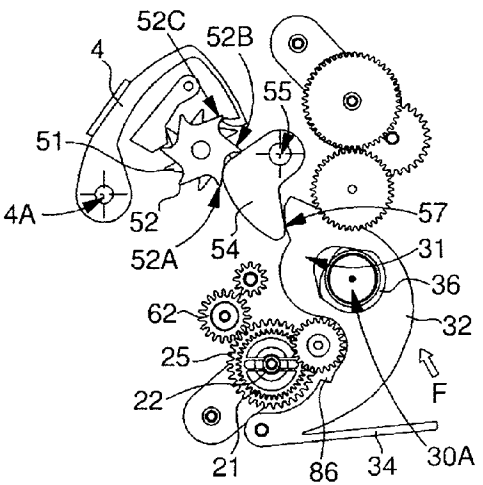

The function of the friction wheel set is to uncouple the time zone wheel 25 from friction wheel 21, which is an additional cannon-pinion that can be uncoupled to operate secondary display 2 alone. The friction is controlled by an intermediate wheel 62, which meshes with time zone wheel 25, and which, in turn, is or is not operated by the set-hands extension pinion 11, as seen in FIG. 21.

Figure 7:
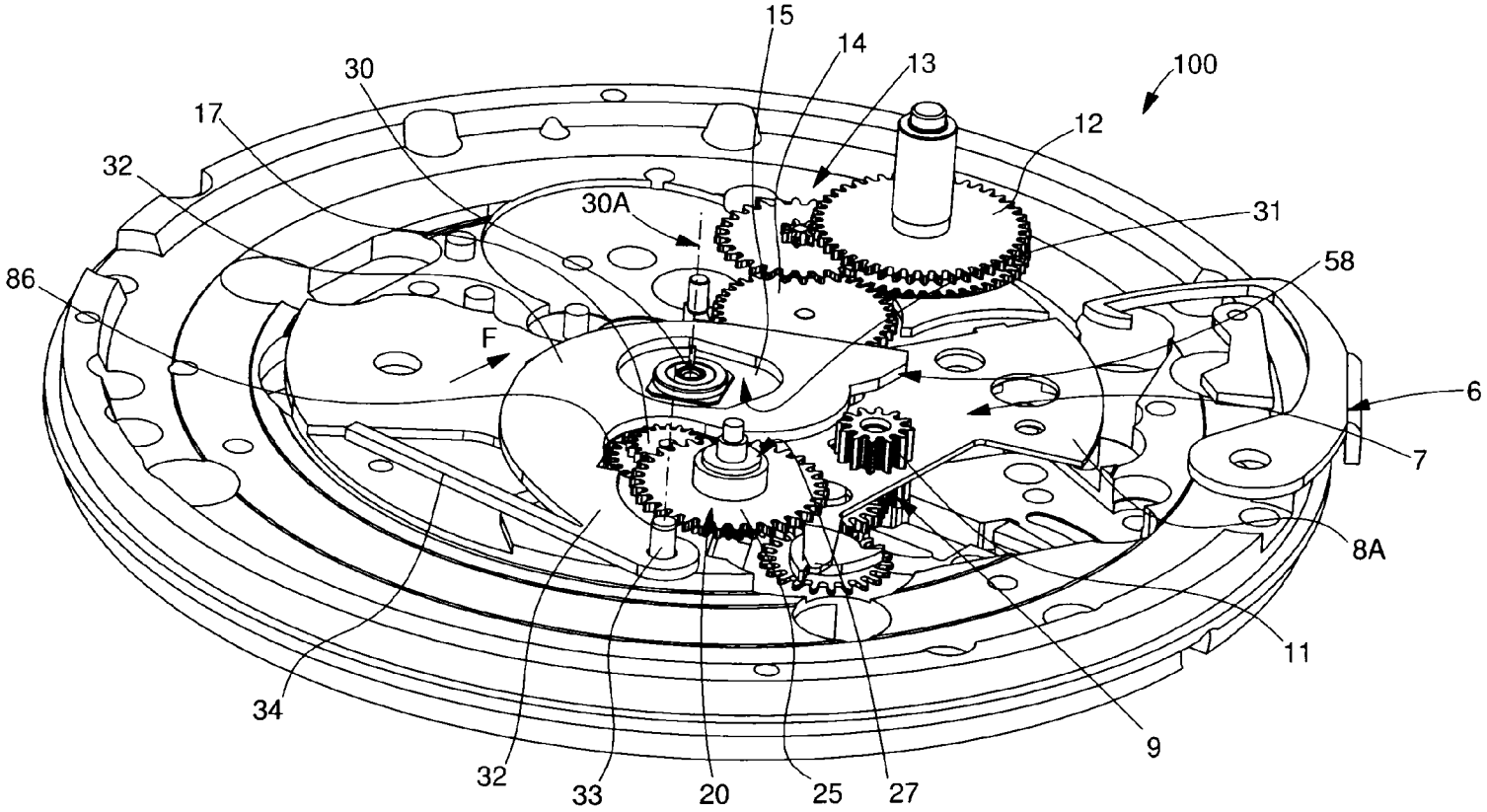

The seconds pivot 30 of basic movement 6 is coaxial to the minute wheel 15, as seen in FIG. 6, and it is at the centre of movement 6 in this embodiment. As seen in FIG. 7, this pivot 30, of axis 30A, is located inside a recess 31 in a stop lever 32, also called, in the particular application of the invention to a chronograph, a chronograph control lever. This chronograph control lever 32 pivots about a lever arbour 33 and is return towards the centre of movement 6, i.e. towards seconds pivot 30, by a lever spring 34, in the direction of arrow F.

Figure 9:
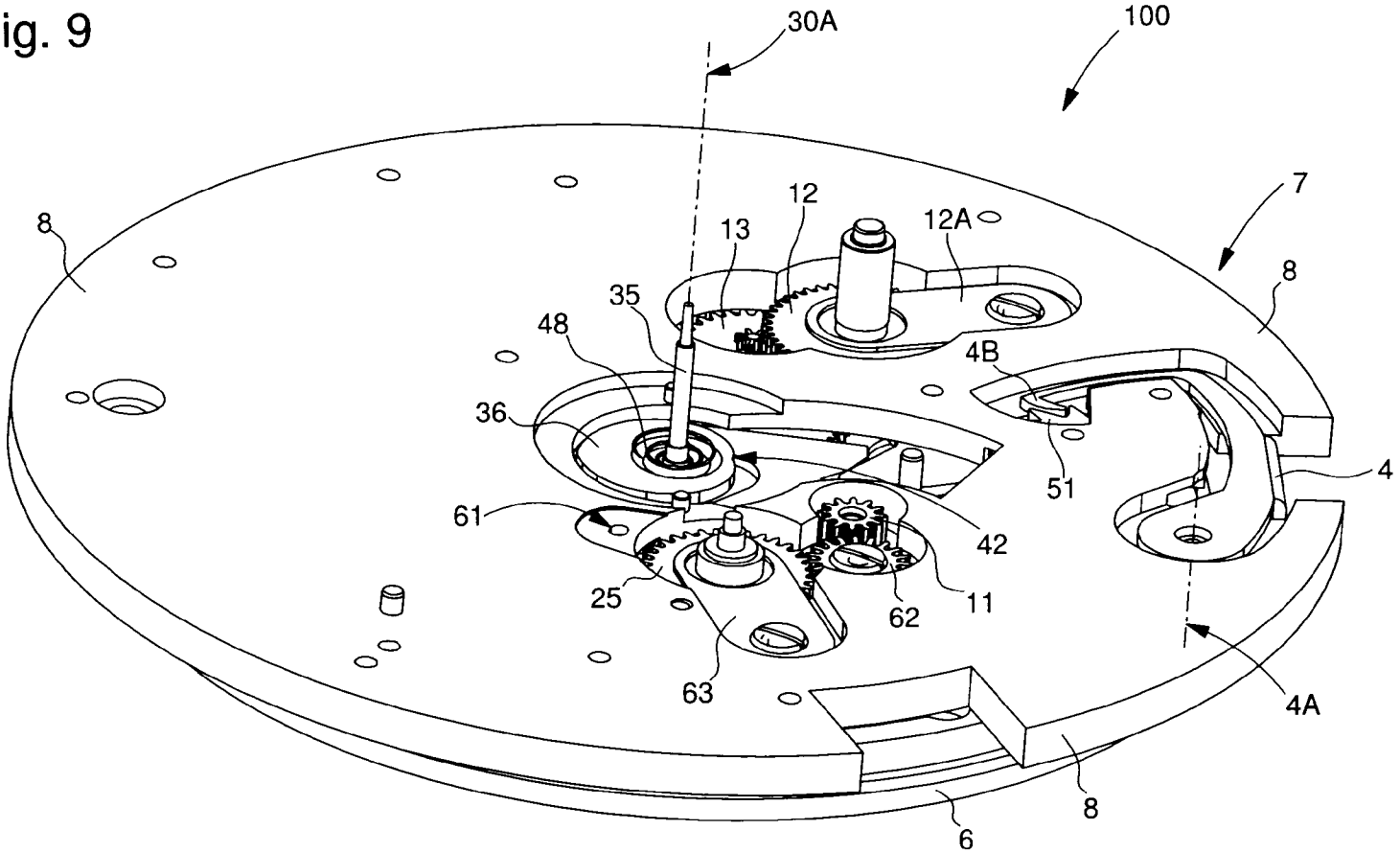
Figure 10:
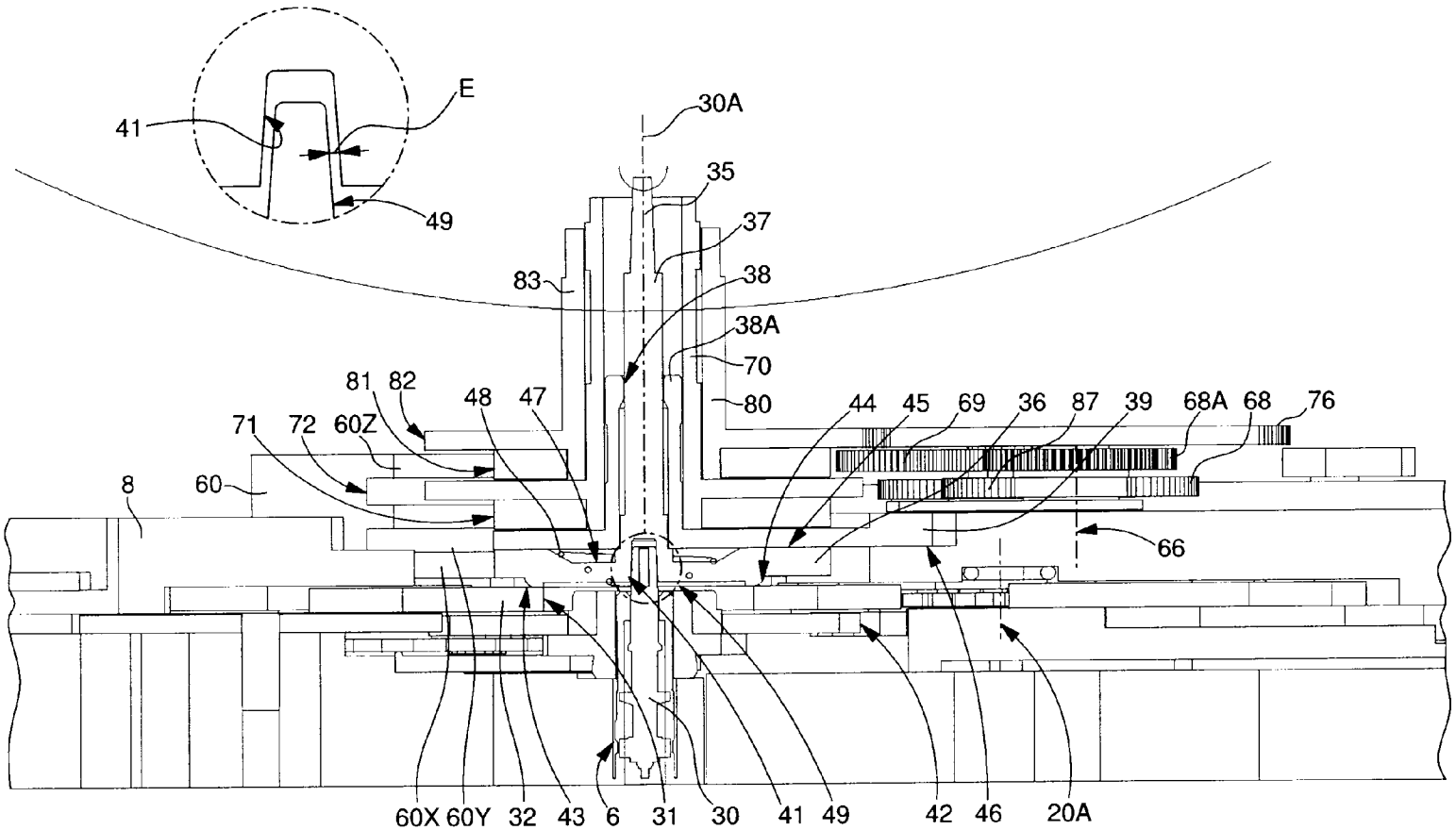
Figure 11:
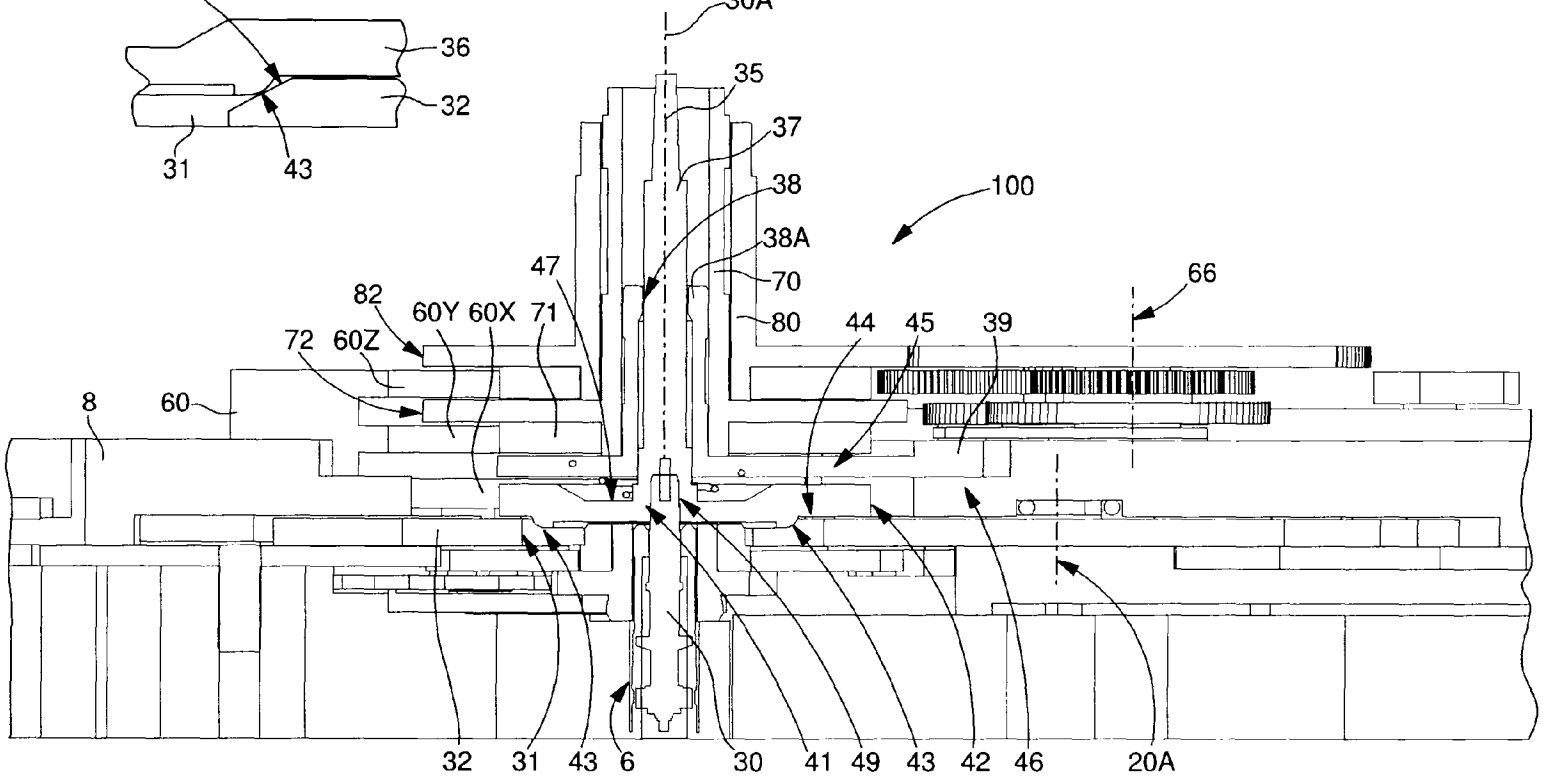

FIG. 9 shows a chronograph seconds pivot 35, coaxial along axis 30A to seconds pivot 30 of basic movement 6. This pivot 35 is for carrying the chronograph seconds hand of second display 2, which is combined with the heart-piece 42 of a seconds cannon-pinion heart 36, said heart-piece 42 being for resetting the chronograph seconds hand to zero. As seen in FIGS. 10 and 11, this seconds cannon-pinion heart 36 includes, underneath said chronograph seconds pivot 35, a stem 37 arranged to slide into a bore 38 comprised in a guide bridge 39 of the chronograph arbour, which guarantees perfect axial hold. This guide bridge 39 is preferably screwed onto the plate 8 which carries mechanism 100.

According to the invention, the first coupling/uncoupling means is formed by a combination of a conical bore 41, respectively a cone, comprised in the pivot axis of the first physical quantity cannon-pinion 36, and a cone 49, respectively a conical bore, comprised in movement 6, or connected thereto. This arrangement applies both to this first embodiment and to the second embodiment set out hereafter, or to further embodiments.

More specifically within this application, where the first physical quantity cannon-pinion heart 36 is a seconds cannon-pinion, on the bottom side, this seconds cannon-pinion heart 36 includes, along the pivot axis thereof, a conical bore 41, which is arranged to cooperate with a conical shoulder 49 comprised in the seconds pivot 30 of movement 6. Those skilled in the art will know how to make the opposite configuration by switching the cone and conical bore.

Figure 12:
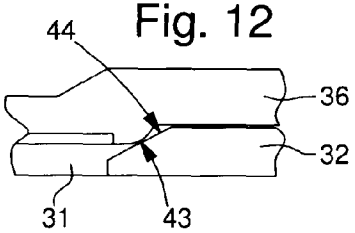

Between stem 37 and conical bore 41, the seconds cannon-pinion heart 36 spreads out in the form of a flange, the peripheral contour of which forms a cam 42 in the form of a conventional timepiece heart-piece, arranged for cooperating with a hammer for return to its original position. This flange includes, on the bottom part thereof, i.e. on the side of conical bore 41, a support surface formed by a bulge or a shelved ramp 43, which is arranged for cooperating with a complementary support surface such as a chamfer 44 on the edge of recess 31 in lever 32, in order, when said lever 32 makes a flat pivoting movement, to move a top surface 45, comprised in the flange of heart 36, closer to or further from a bottom surface 46, comprised in guide bridge 39, as seen in FIGS. 11 and 12.

The seconds cannon-pinion heart 36 also includes, in the top part thereof on the stem 37 side, a housing 47, which is arranged for receiving a first end of a return spring 48, the other end of which rests on the bottom surface 46 of guide bridge 39.

When the chronograph is stopped, the bottom surface 46 of guide bridge 39 and the top surface 45 of heart 36 are in contact, whereas conical bore 41 is at a distance E from cone 49 of seconds pivot 30 of movement 6.

When the chronograph is operating, spring 48 inserted between guide bridge 39 and heart 36 presses conical surfaces 41 and 49 against each other, forming a complete coupling, whereas the top surface 45 of flange of the seconds cannon-pinion heart 36 is at a distance from the bottom surface 46 of guide bridge 39.

To bring lever 32 into a pushed-in position, where chamfer 44 of recess 31 pushes ramp 42 of heart 36 as seen in FIG. 12, the first start-stop push-button 4 pivots about the axis 4A thereof. A spring (not shown in the Figures) tends to push it back outwards.

Figure 13:
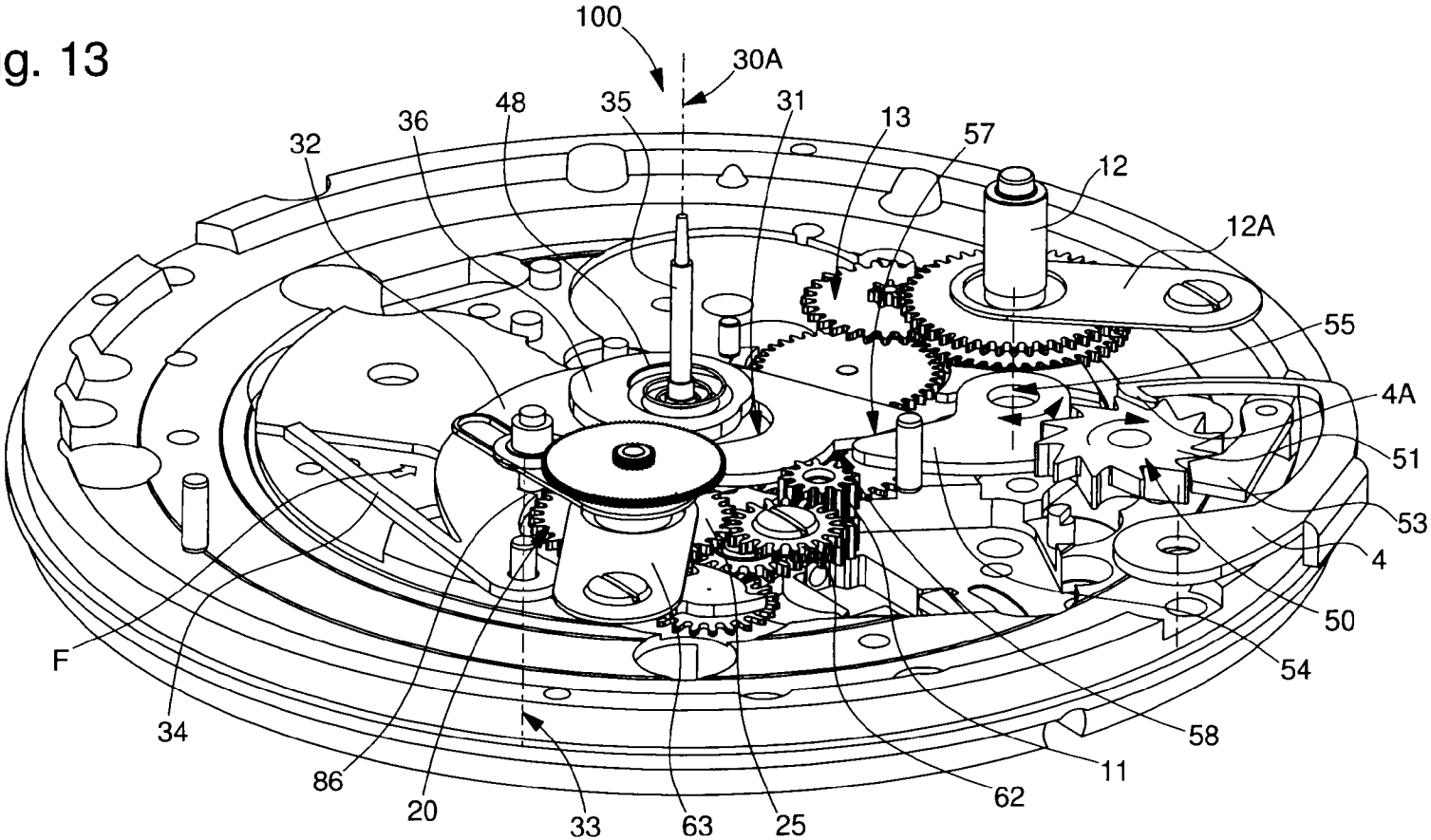
Figure 16:
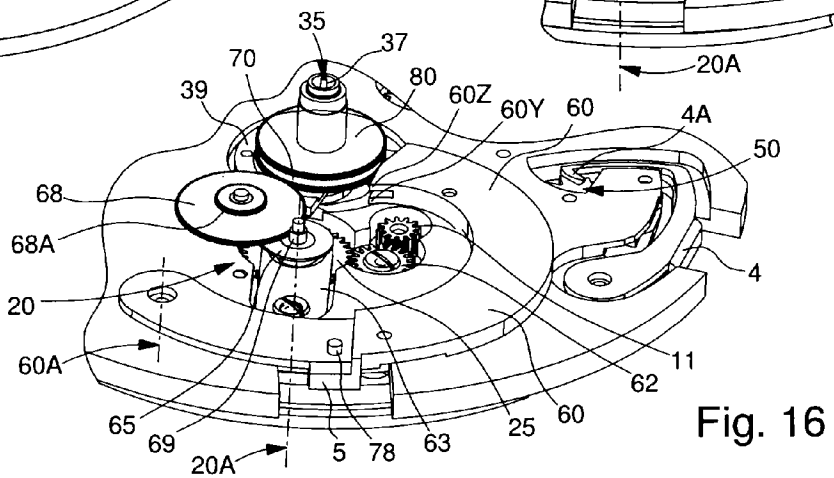
Figure 18:
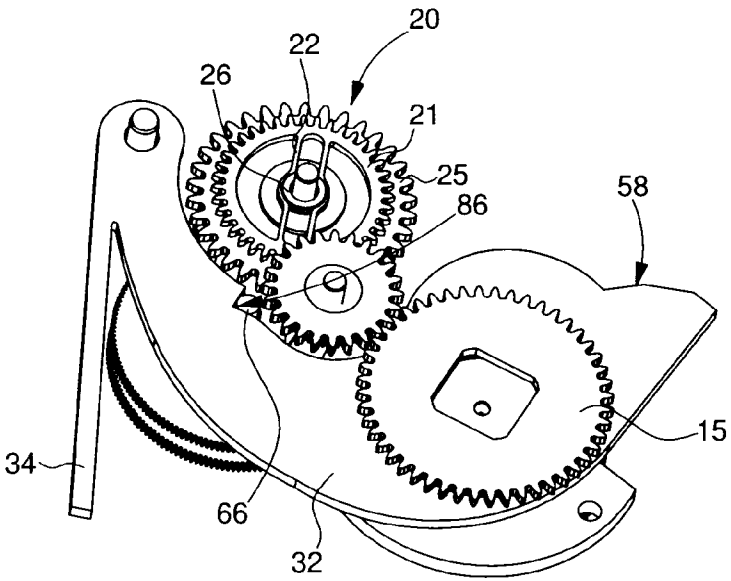
Figure 17:
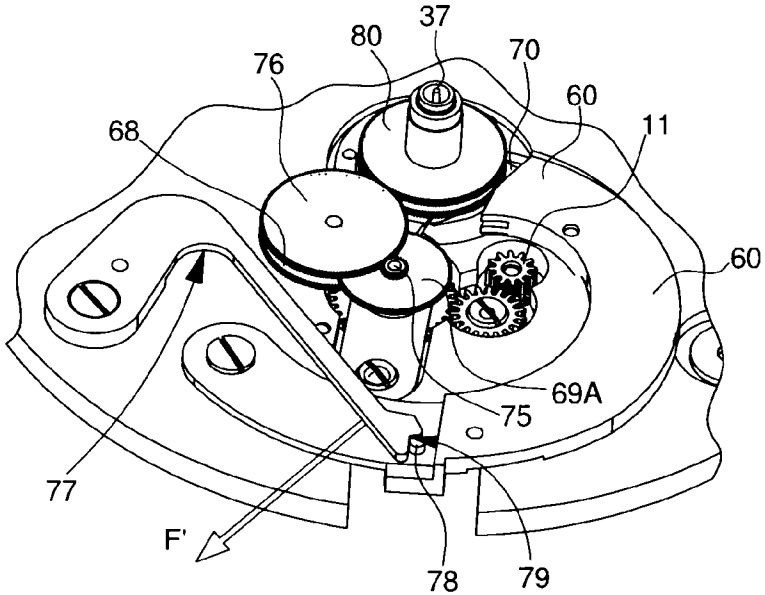
Figure 20:
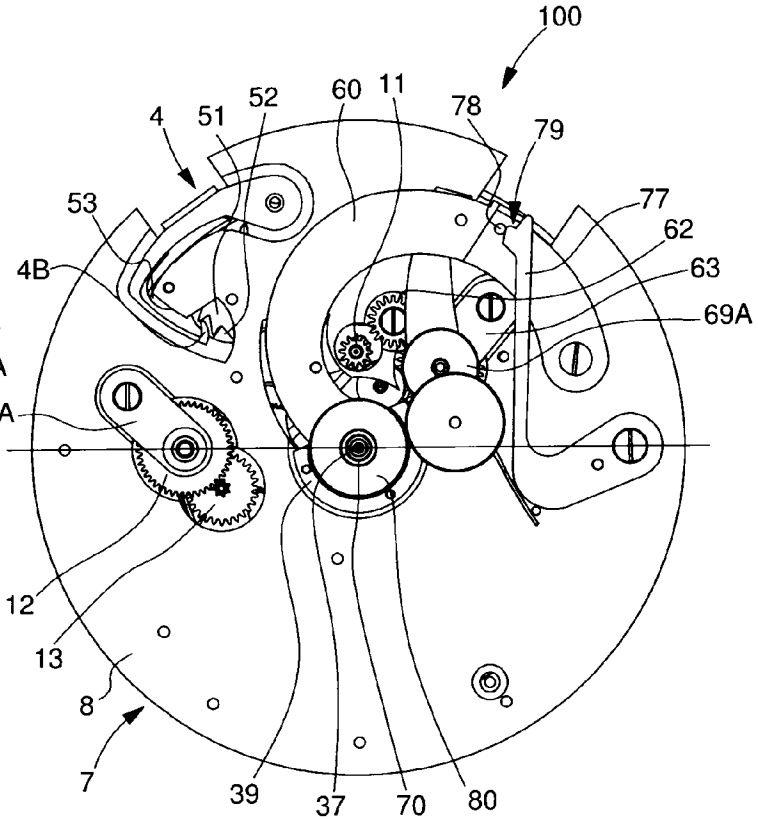
Figure 19:
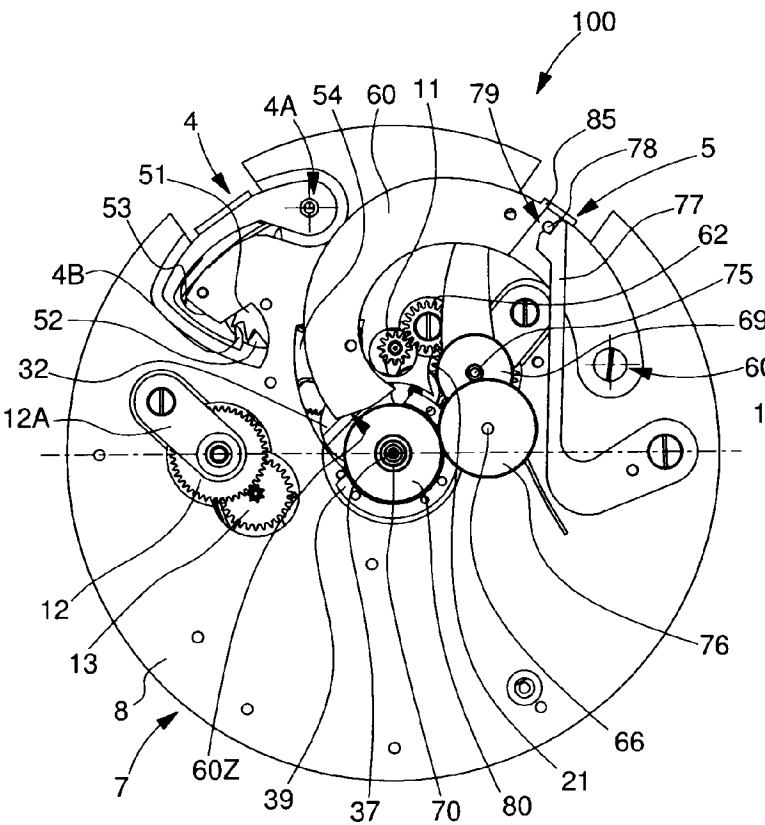

As seen in FIGS. 13 and 16, start-stop push-button 4 includes or directly drives a tooth 4A, which activates control means of first coupling/uncoupling means, formed by a top toothed wheel 51 comprised in a column wheel 50 or a similar mechanism, and which is integral with a coaxial bottom toothed wheel 52. The top toothed wheel 51, which for example forms part of a column wheel 50 or suchlike, with an integer number of teeth, is held by a jumper spring 53. When pressure is applied to first push-button 4, the tooth 4A thereof tends, during the return movement thereof outwards via the action of the spring, to rotate in the direction of the arrow of FIG. 13.

Figure 14:
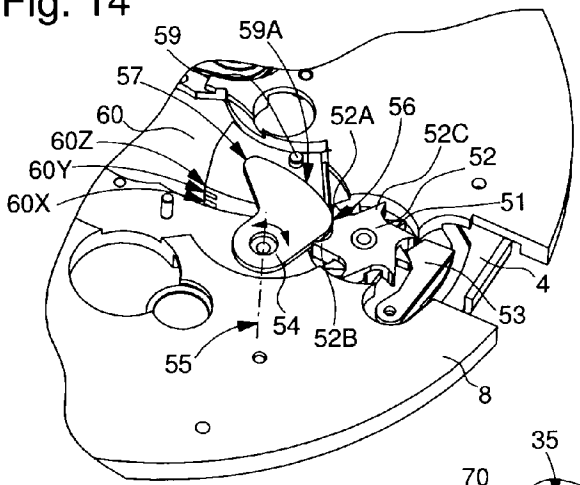

FIG. 14 shows, on the opposite side to that shown in FIG. 13, the second bottom toothed wheel 52, coaxial and integral with the top toothed wheel 51, belonging to the same column wheel 50 and wherein the number of teeth is half that of the top toothed wheel 51, and wherein two consecutive teeth 52A and 52B immobilise in position, at a given time, a first sliding gear 54, which is mounted to pivot about a sliding gear arbour 55. This bottom wheel 52 is arranged to cooperate with a first support surface of a sliding gear 54 which can pivot about an arbour 55. This sliding gear 54 includes a second support surface 57, which cooperates with an edge 58 of the stop lever 32. This stop lever 32 pivots about an arbour 33 and includes a recess 31 provided with a chamfer 44 arranged to cooperate with a ramp 43 comprised in the seconds cannon-pinion heart 36 for raising or lowering the latter. When the top toothed wheel 51 pivots, the bottom toothed wheel 52 also pivots, and, in a first movement corresponding to action by the user on first push-button 4, pushes back, via the tip of tooth 52A, a first support surface 56 comprised in sliding gear 54. It thus moves a second support surface 57, comprised in the other end of first sliding gear 54, closer towards axis 30A of the seconds pivot, and thus pushes lever 32 underneath the flange of the seconds cannon-pinion heart 36 and thereby couples seconds pivot 30 of movement 6 and stem 37 of the seconds cannon-pinion heart 36.

The next action of the user on first push-button 4 immobilises the top toothed wheel 51 in a new angular position. The bottom toothed wheel 52 thus occupies a new angular position, in which two teeth 52A and 52C lock the first support surface 56 into a position where the first sliding gear 54 is moved away from the seconds pivot axis 30A, and where the chronograph control lever 32 is released from heart 36, which is thus uncoupled from the seconds pivot 30 of movement 6. Spring 48 tends to permanently push back heart 36 of pivot 30 which ensures instantaneous uncoupling. The second support surface 57 of the first sliding gear 54 rests on an edge 58 of lever 32 to control the pivoting of said lever.

In short, the first sliding gear 54 makes an alternate movement each time there is action on first push-button 4. In a particular variant, edge 58 has a hollow 58A or a notch, or a v, or similar, to hold the second support surface 57 of sliding gear 54 in a stable position.

This first sliding gear 54 also cooperates, as seen in FIG. 14, with a pion 59 comprised in a fly-back lever 60, the role of which will be explained hereafter.

Advantageously according to the invention, the first push-button 4 and second push-button 5 are independent and the function of one may occur at any time, taking priority over the other.

Figure 15:
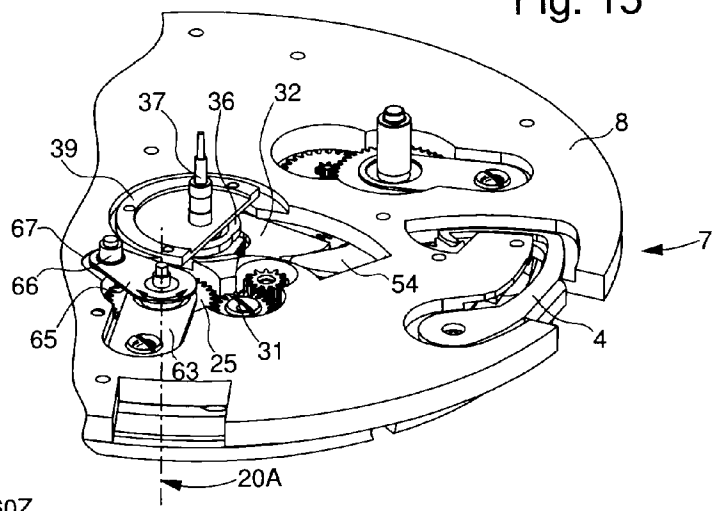

FIG. 9 shows an oblong hole 61 in plate 8. This oblong hole 61 is for receiving an arbour 66 carried by a chronograph lever 65. This chronograph lever 65 is shown in FIG. 15 and can pivot about axis 20A of time zone wheel set 20, above a plate 63 which immobilises said time zone wheel set 20 axially. This chronograph lever 65 preferably moves in a countersink 67 in plate 8. A return spring, particularly a U-shaped spring, not shown in the Figures, holds said arbour 66 in oblong hole 61.

According to the invention, stop lever 32 is returned towards sliding gear 54 by a lever spring 34 and includes a lever notch 86, which is arranged for driving an arbour 66. This arbour 66 bears an intermediate minute wheel set 90 that pivots freely about arbour 66, to mesh with minute cannon-pinion heart 76, when the first coupling/uncoupling control means is in the coupling position.

To start the pivoting of chronograph lever 65 in oblong hole 61, notch 86, visible in FIGS. 22 to 25, acts as connecting member between pivot axis 33 of level 32 and control recess 31 of seconds heart 36. This notch 86, which may also be called the chronograph control milling, abuts on arbour 66 of sliding gear 63. In the continuous operating position of secondary display 2, i.e. when push-button 4 is pushing sliding gear 54 towards the seconds pivot axis 30A and causing chamfer 44 of lever 32 to cooperate with ramp 43 of seconds heart 36, lever spring 34 is stronger than return spring 64 of chronograph lever 65 and notch 86 pushes arbour 66. Notch 86 thus also pushes a chronograph minute drive wheel 68 and a chronograph hour drive wheel 76, which are coaxially mounted in relation to each other on arbour 66, in a position respectively meshing with a minute cannon-pinion heart 70 and an hour cannon-pinion heart 80, which are both coaxial to the axis 30A of seconds pivot 30.

When the next action on first push-button 4 moves the first sliding gear 54 away from the seconds pivot axis 30A, lever 32 is released from heart 36 and remains locked in this position by the first sliding gear 54, the bottom toothed wheel 32 and jumper spring 53. Return spring 64 then moves arbour 66 away from seconds pivot axis 30A, and disengages wheels 68 and 76 respectively from cannon-pinion hearts 70 and 80.

Upon action by the user, crown 3 is arranged to occupy a position T3 for setting secondary display 2, in which the time zone wheel 25 cooperates, via an intermediate motion wheel set 62, with motion work 13.

When crown 3 is in a pulled out position, everything is driven by the cannon-pinion. Time-setting intermediate wheel 11 is disconnected from intermediate pinion 62.

In a preferred embodiment, as shown in the Figures, the first physical quantity cannon-pinion heart 36, and at least a second physical quantity cannon-pinion heart 70 and/or a third physical quantity cannon-pinion heart 80 are mounted coaxial to a movement clamp directly connected to movement 6 or comprised therein.

In the embodiment described in detail here, the second physical quantity cannon-pinion heart 70 is a minute cannon-pinion heart, and the third physical quantity cannon-pinion heart 80 is an hour cannon-pinion heart.

These arrangements apply both to the first embodiment and to the second embodiment set out hereafter, and to other embodiments.

As shown in FIGS. 10 and 11, guide bridge 39, which has an integral part 38A enclosing bore 38, which guides stem 37 of chronograph seconds pivot 35, is covered by a minute cannon-pinion heart 70. The bottom part of this minute cannon-pinion heart 70 includes a heart-piece 71, arranged for cooperating with a hammer to return said heart to the original position thereof. The peripheral part includes a toothing 72, and the top part thereof an arbour 73 including a bore 74, which pivots on the integral part 38A of guide bridge 39.

This minute cannon-pinion heart 70 is, as seen in FIGS. 10 and 11, itself coaxially covered by an hour cannon-pinion heart 80, which is arranged in a similar manner, and includes, in the bottom part thereof a heart-piece 81 arranged for cooperating with a hammer for returning said heart to the original position thereof. The peripheral part includes a toothing 82 and the top part thereof an arbour 83, including a bore 84, in which arbour 73 of minute cannon-pinion heart 70 pivots.

It is clear that, although seconds cannon-pinion heart 36 does not need a toothing in order to be driven, which is achieved by the conical fit of movement 6 onto seconds pivot 30, cannon-pinion hearts 70 and 80 do require toothings 72 and 82 in order to be made to pivot.

In order to hold cannon-pinion hearts 36, 70 and 80 in position, when the centre secondary display 2 is stopped by another application of pressure on first push-button 4, mechanism 100 advantageously includes friction means (not shown in the Figures), such as metal foils or suchlike.

Preferably, when pushed in, the second push-button 5 causes a fly-back lever 60 to move so as to abut on heart-pieces 42, 72, 82 and return said heartpieces to their original position. FIG. 16 shows that second push-button 5 pivots fly-back lever 60 about the pivot axis 60A thereof. This fly-back lever 60 includes, at the end thereof opposite the pivot, hammers 60X, 60Y, 60Z, which are arranged to be inserted between the heart flanges like a comb, and to impose, in a single movement, an identical return movement on all of the peripheral cams of the various hearts, so as to reset to zero simultaneously the hour, minute and seconds hands of secondary display 2, which are respectively mounted on cannon-pinion heart 36 and cannon-pinion hearts 70 and 80.

Fly-back hand 60 also includes pion 59, which interacts with the first sliding gear 54, as seen in FIG. 14, on a surface 59A of said first sliding gear 54.

If second push-button 5 is activated, fly-back lever 60 is pivoted and first sliding gear 54 tends to be pushed, via pion 59, forcing said sliding gear to pivot, and the chronograph is then stopped if it was operating. Conversely, if first push-button 4 is activated to start the chronograph, pion 59, and thus fly-back lever 60 is pushed again. Each operation tends to cancel out the other.

Arbour 66 is arranged at an opposite end to the pivot of chronograph lever 65, which is coaxial to the pivot axis 20A of time zone wheel set 20. This arbour 66 can move in oblong hole 61, depending upon the angular position of chronograph lever 65. Arbour 66 carries a toothed chronograph minute drive wheel 68, which, depending upon the position of the sliding gear, may of may not mesh with toothing 72 of minute cannon-pinion heart 70. This toothed wheel 68 is free, driven by time zone wheel set 20 and completes one revolution per hour. It has the same number of teeth as toothing 72 of minute cannon-pinion heart 70. The latter thus also completes one revolution per hour when it is driven.

When the distant position of the second sliding gear prevents any transfer of torque towards minute and hour cannon-pinion hearts 70 and 80, the minute and hour hands respectively connected to said hearts are not driven, since nothing is touching them: seconds heart 36 is pivoted simply by being guided in bore 74 in minute cannon-pinion heart 70 without any driving effect, and the same is a fortiori true for hour cannon-pinion heart 80. If, however, the second hand is operating, the other hands operate too, since all three are controlled by chronograph control lever 32.

As shown in FIG. 21, arbour 66 carries an intermediate minute wheel set 90, which can pivot freely and which includes, superposed on each other and pivoting together, the toothed chronograph minute drive wheel 68, a second wheel 68A and a third wheel 68B. The second wheel 68A meshes with a chronograph minute drive wheel 69 which drives said second wheel, arranged on support surface 27 of time zone wheel 25, and which is coaxial to an intermediate hour wheel set 91, which is mounted coaxial to axis 20A of time zone wheel set 20. This chronograph minute drive wheel 69 pivots integrally with time zone wheel 25, for example via a flat portion, a key or suchlike. The intermediate hour wheel set 91 pivots freely about axis 20A, and includes, superposed, above said chronograph minute drive wheel 69, a second wheel 69A and a pinion 75, which pivot integrally with each other. The second wheel 69A is driven by a third wheel 68B of the intermediate minute wheel set. Pinion 75 meshes in turn with an intermediate hour wheel 76, mounted to pivot freely on arbour 66, which includes the same number of teeth as toothing 82 of hour cannon-pinion heart 80. The reduction ratio between pinion 75 and wheel 76 thus determines the pivoting speed of hour cannon-pinion 80, which is conventionally one revolution in twelve hours. The free intermediate chronograph hour wheel 76, like chronograph minute drive wheel 68, may or may not mesh with toothing 82 of hour cannon-pinion heart 80, depending upon the angular position of chronograph lever 65.

It is friction wheel 21, which permanently rotates at a rate of one revolution per hour, which ensures the driving, by transmitting the torque derived from basic movement 6. Since it is a friction wheel, while rotating it may or may not be uncoupled from time zone wheel 25 of time zone wheel set 20. In short, when there is friction, this friction wheel 21 ensures the entire driving of secondary display 2.

Preferably, the second zero reset push-button 5 drives a fly-back lever 60, to rest on the seconds cannon-pinion heart 36 and on minute cannon-pinion heart 72, to return said hearts to the original position thereof. A fly-back spring 77 is arranged for cooperating or not cooperating, via a notch 79 comprised in spring 77, with a pion 78 comprised in fly-back lever 60. Spring 77 tends to exert an effort on fly-back lever 60, via this pion 78, in the direction of arrow F' in FIG. 17, which tends to move said lever away from seconds cannon-pinion heart 36 and minute cannon-pinion heart 72.

Another return spring 85 tends to return the second push-button 5 outwards. When this second push-button 5 is pressed, the resistant force of fly-back spring 77 has to be overcome, which allows a change from the position shown in FIG. 19 to the position shown in FIG. 20.

When the chronograph is in the operating position, sliding gear 54 is idle at the bottom of column wheel 50 and on pion 59 of fly-back lever 60. If the user manages to operate the two push-buttons 4 and 5 simultaneously, the pressure on the two push-buttons 4 and 5 causes the same reaction of causing sliding gear 54 to pivot and stopping the chronograph function.

However, it the chronograph is stopped, the pressure on the second push-button 5 merely resets the hearts to zero, since the travel thereof is limited, so that pion 59 can only join sliding gear 54 and cannot push it further than column wheel 50 has done. If the first push-button 4 is pressed at the same time, the only result will be to start the chronograph, once the second push-button 5 has been released. Thus, even if the user manages to simultaneously operate both push-buttons 4 and 5, which is very difficult, nothing would be broken, since the two functions can coexist perfectly.

To summarize the operation of mechanism 100 in this first embodiment, the results of various actions on crown 3, first push-button 4 and second push-button 5 on the display are set out below:

T1, crown 3 pushed in, first, S/S (stop/start) push-button 4 in the start position, no action on second push-button 5: chronograph activated;

T1, crown 3 pushed in, first, S/S push-button 4 in start position, push-button 5 activated and released: secondary display 2 reset to zero and chronograph restarts immediately. The fly-back has an instantaneous function, it cannot remain pushed in, it immediately returns to the external position;

T1, crown 3 pushed in, first, S/S push-button 4 in start position, push-button 5 held pushed in: secondary display 2 reset to zero and secondary display 2 stopped.

T1, crown 3 pushed in, first, S/S push-button 4 in stop position, no action on second push-button 5: secondary display 2 released, the three hands remain in the position in which they were uncoupled by the first push-button 4;

T1, crown 3 pushed in, first, S/S push-button 4 in stop position, push-button 5 activated and released: secondary display 2 reset to zero. Once the fly-back has been released, the three hands of secondary display 2 are reset to zero and remain there;

T1, crown 3 pushed in, first, S/S push-button 4 in stop position, push-button 5 held pushed in: secondary display 2 reset to zero and secondary display 2 stopped.

in position T1 it is not possible to set the hands of either the first display 1 or second display 2.

T2, first intermediate traction, first, S/S push-button 4 in start position, no action on second push-button 5: displays 1 and 2 uncoupled. The uncoupling is achieved not by the crown, but comes from the push-button action. The secondary display 2 continues operating and no manipulation thereof is possible. The main display 1 is not affected.

T2, first intermediate traction, first, S/S push-button 4 in start position, second push-button 5 activated then released: displays 1 and 2 uncoupled. The uncoupling is achieved not by the crown, but comes from the push-button action. The secondary display 2 continues operating and can be manipulated. The main display 1 is not affected.

T2, first intermediate traction, first, S/S push-button 4 in start position, second push-button 5 held pushed in: display 2 is stopped and manipulation thereof is no longer possible. The main display 1 is not affected.

T2, first intermediate traction, first, S/S push-button 4 in stop position, no action on second push-button 5: displays 1 and 2 uncoupled. Secondary display 2 can be manipulated for hands-setting. The main display 1 is not affected.

T2, first intermediate traction, first, S/S push-button 4 in stop position, second push-button 5 activated then released: displays 1 and 2 uncoupled. Secondary display 2 is reset to zero. The secondary display 2 stops operating. It cannot be manipulated to set the hands. The main display 1 is not affected.

T2, first intermediate traction, first, S/S push-button 4 in stop position, second push-button 5 held pushed in: displays 1 and 2 uncoupled. Secondary display 2 is reset to zero. Secondary display 2 is stopped. It cannot be manipulated to set the hands. The main display 1 is not affected.

T3, complete traction, first, S/S push-button 4 in start position, no action on second push-button 5: displays 1 and 2 coupled. Possible to manipulate both displays 1 and 2 at the same time.

T3, complete traction, first, S/S push-button 4 in start position, second push-button 5 activated then released: secondary display 2 reset to zero. Possible to manipulate both displays 1 and 2 at the same time.

T3, complete traction, first, S/S push-button 4 in start position, second push-button 5 held pushed in: displays 1 and 2 coupled. Secondary display 2 is reset to zero. The secondary display 2 stops operating. Only possible to manipulate the off-centre main display 1;

T3, complete traction, first, S/S push-button 4 in stop position, no action on second push-button 5: displays 1 and 2 coupled. Possible to manipulate both displays 1 and 2 at the same time.

T3, complete traction, first, S/S push-button 4 in stop position, second push-button 5 activated then released: secondary display 2 reset to zero. Secondary display 2 locked and it is only possible to manipulate the off-centre main display 1.

T3, complete traction, first, S/S push-button 4 in stop position, second push-button 5 held pushed in: displays 1 and 2 separated. Secondary display 2 is reset to zero. Only possible to manipulate the off-centre main display 1;

It is clear that the second push-button 5 is not intended to remain pushed in. The combination of holding second push-button 5 pushed in and operating crown 3 can only be achieved via a deliberate action by the user.

FIGS. 26 to 36 illustrate a second embodiment, which is even more advantageous than the first embodiment, since it has fewer components, and which is described hereafter. Numerous common elements are designated in the same manner with the same numbering and will not be explained again, except where there is particular cooperation with the mechanism of the second embodiment.

The object of this second embodiment, apart from simplifying the mechanism, is to ensure the total separation of the functions of the two push-buttons: first start/stop push-button 4 and second reset push-button 5.

Thus, the object is to make the fly-back function possible at any time. To achieve this, the chronograph gear has to be disconnected from the centre wheels. The second embodiment therefore implements a chronograph control lever 132, which is special, and arranged to raise and easily disconnect the gear without using any force.

Thus, according to the invention, the second coupling/uncoupling control means includes an inter-time zone mechanism 93 carried by a control lever 132 comprised in the control means of first coupling/uncoupling means. This inter-time zone mechanism 93 is a coupling mechanism, and includes a bottom wheel 98 meshing directly both with movement 6 and a top wheel 96. When inter-time zone mechanism 93 is in the coupled position, top wheel 96 is arranged for directly or indirectly driving at least the second physical quantity cannon-pinion heart 70 and/or the third physical quantity cannon-pinion heart 80.

Figure 26:
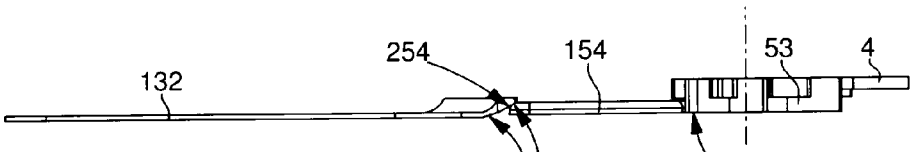
FIGS. 26 to 36 illustrate a second embodiment.

The mechanism formed of second push-button 4, column wheel 50 and jumper spring 53 is maintained. However, as seen in FIG. 26, column wheel 50 interacts, in this second embodiment, with a first sliding gear 154 whose shape is altered with respect to sliding gear 54 of the first embodiment. The first sliding gear 154 of the second embodiment includes, at the periphery thereof, a chamfered edge 254. This chamfered edge 254 acts with a new chronograph control lever 132, which is simplified with respect to stop lever 32 of the first embodiment.

This chronograph control lever 132 includes a sloped edge 232, which is arranged to face chamfered edge 254 of first sliding gear 154. The pivoting motion of first sliding gear 154 thus causes, not just pivoting around the seconds pivot axis 30A, but also a movement of translation of chronograph control lever 132 parallel to said seconds pivot axis 30A, either upwards or downwards, depending upon the direction in which first sliding gear 154 pivots.

Figure 27:
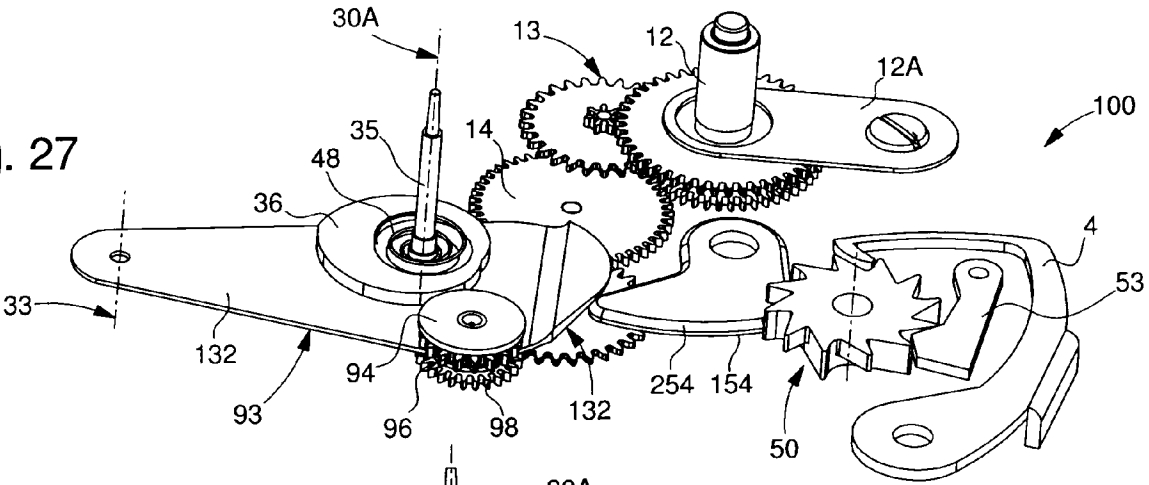
Figure 28:
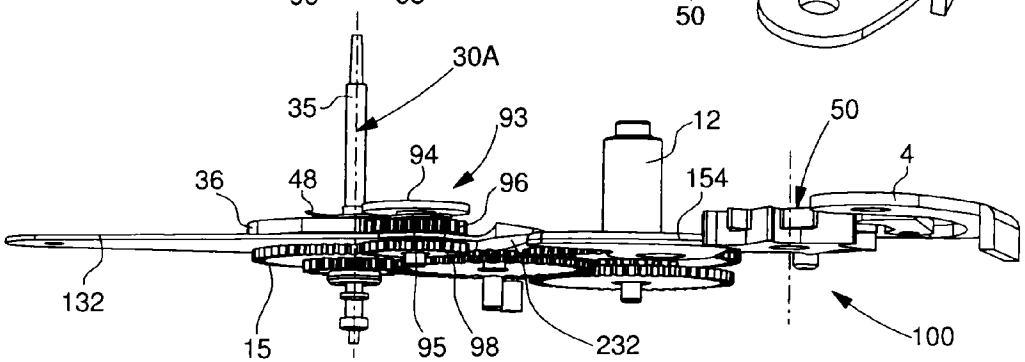

FIGS. 27 and 28 show the chronograph control lever 132 pivoting about seconds pivot axis 30A of the movement. The second chronograph pivot 35, seconds reset heart 36, and spring 48 are arranged in the same way as in the first embodiment, coaxially around said axis 30A.

Chronograph control lever 132 carries the inter-time zone mechanism 93. This inter-time zone mechanism 93 is a coupling mechanism, in particular a conical coupling mechanism in the preferred example shown in the Figures, and includes, as seen in FIGS. 31 and 32, on either side of lever 132, a top flange 94 and a bottom wheel 98, secured to each other by a hub 97, and also, between lever 132 and the top flange 94, a top wheel 96 that moves axially relative to hub 97.

Figures 29, 30, 31, 32:
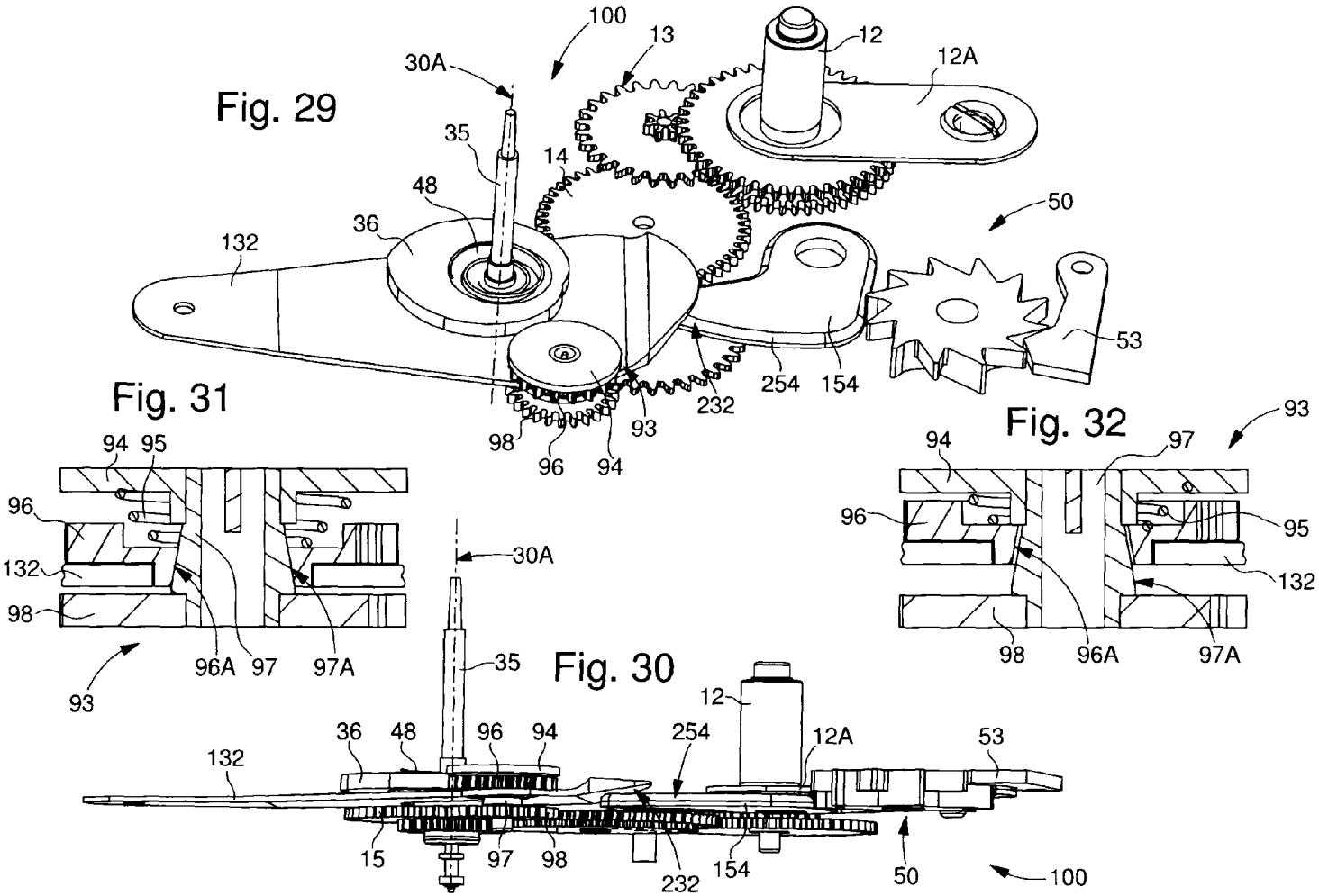

This hub 97 includes a slope 97A, which is arranged to cooperate with a complementary slope 96A comprised in top wheel 96, in a coupling position shown in FIG. 31, in which the top wheel 96 is pressed onto hub 97, via the action of a spring 95, and then becomes synchronous with bottom wheel 98, in mesh with movement 6.

This coupling position is shown in FIGS. 27 and 28. In this position, the display is transmitted to the chronograph display or to the time zone display.

FIG. 32 illustrates the uncoupled position of this inter-time zone mechanism 93. FIGS. 29 and 30 show inter-time zone mechanism 93 in this uncoupled position, which results from the engagement of the first sliding gear 154 underneath chronograph control lever 132 and the lifting of the said lever by first sliding gear 154. Thus, top wheel 96 rises towards top flange 94 and is uncoupled from bottom wheel 98. In this position, the bottom wheel 98 is no longer driving, but top wheel 96 is locked. Consequently, in the event of any shock, the chronograph display does not move, and it is not necessary to install a brake.

Figure 33:
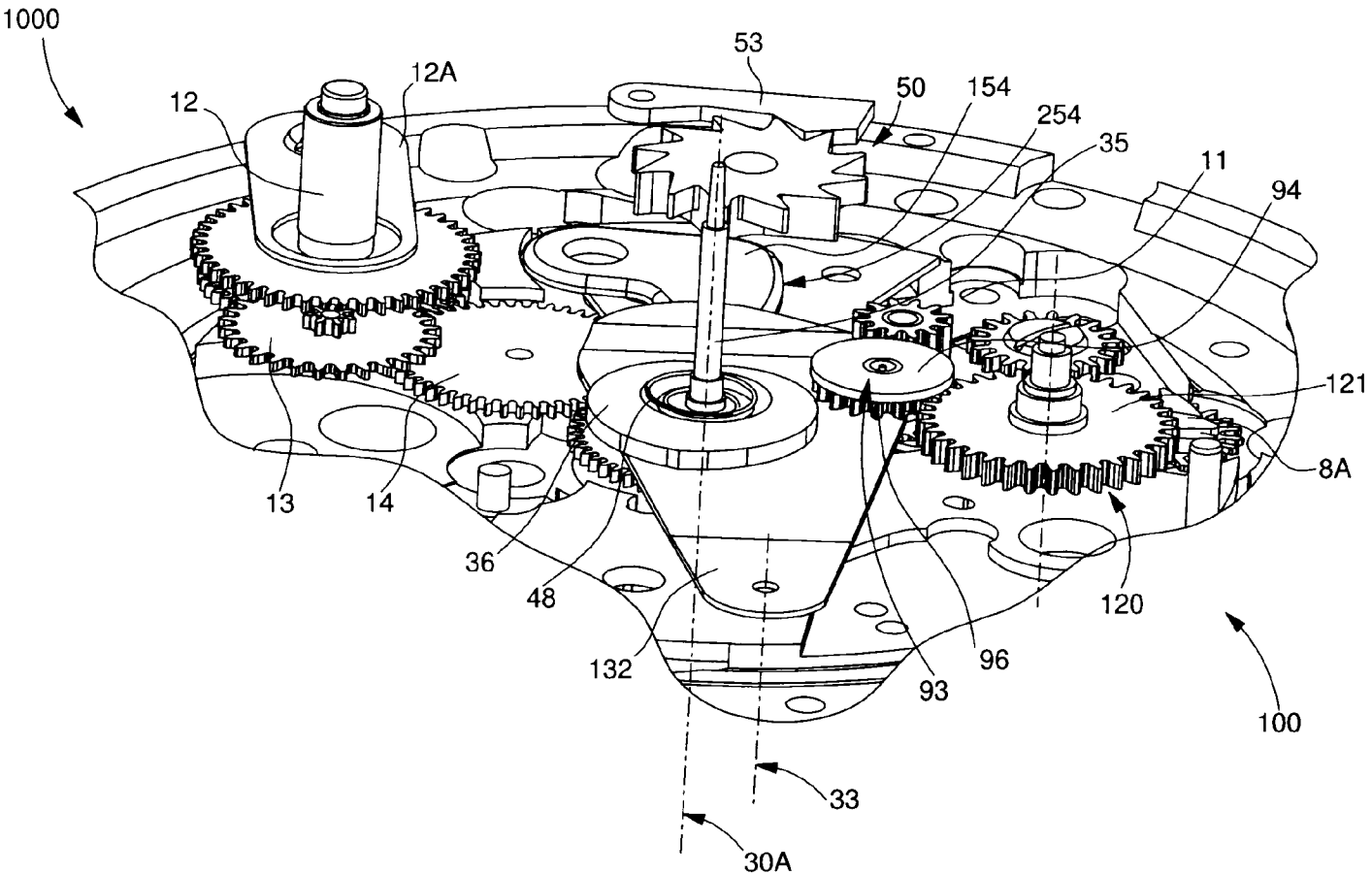
Figure 33A:
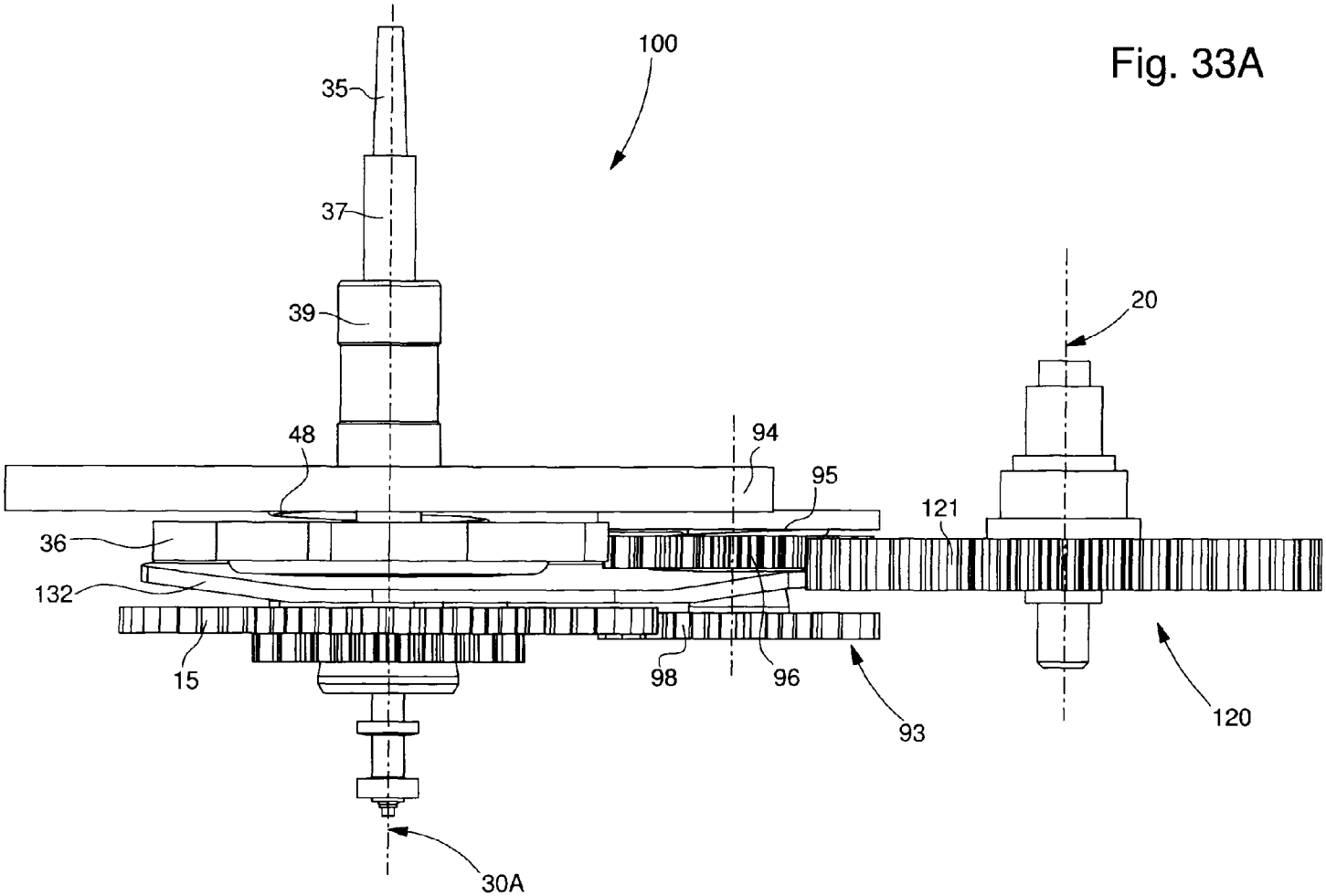
FIGS. 33A and 33B show side views respectively of the inter-time zone mechanism in the coupled and uncoupled positions.
Figure 33B:
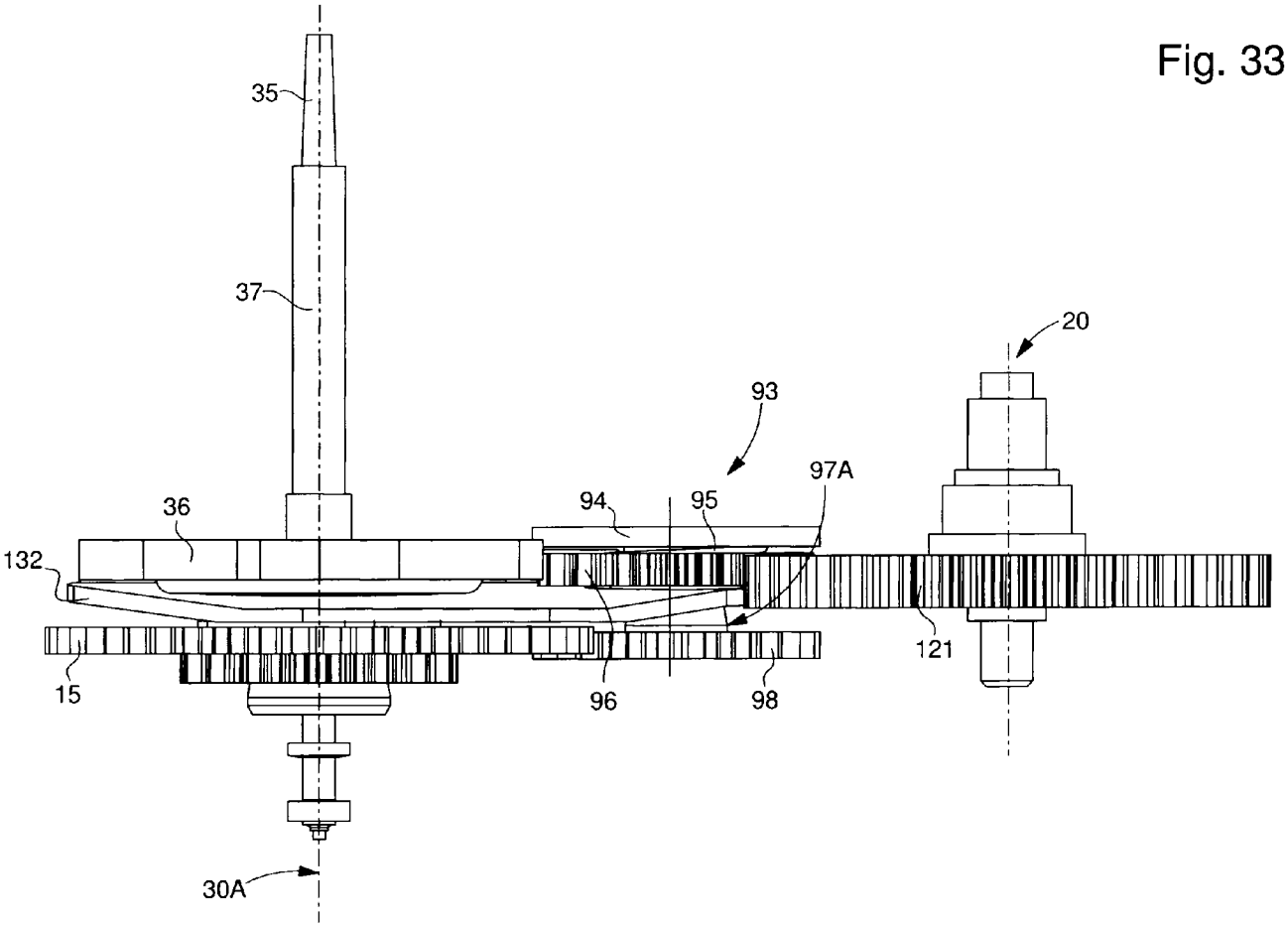
Figure 33C:
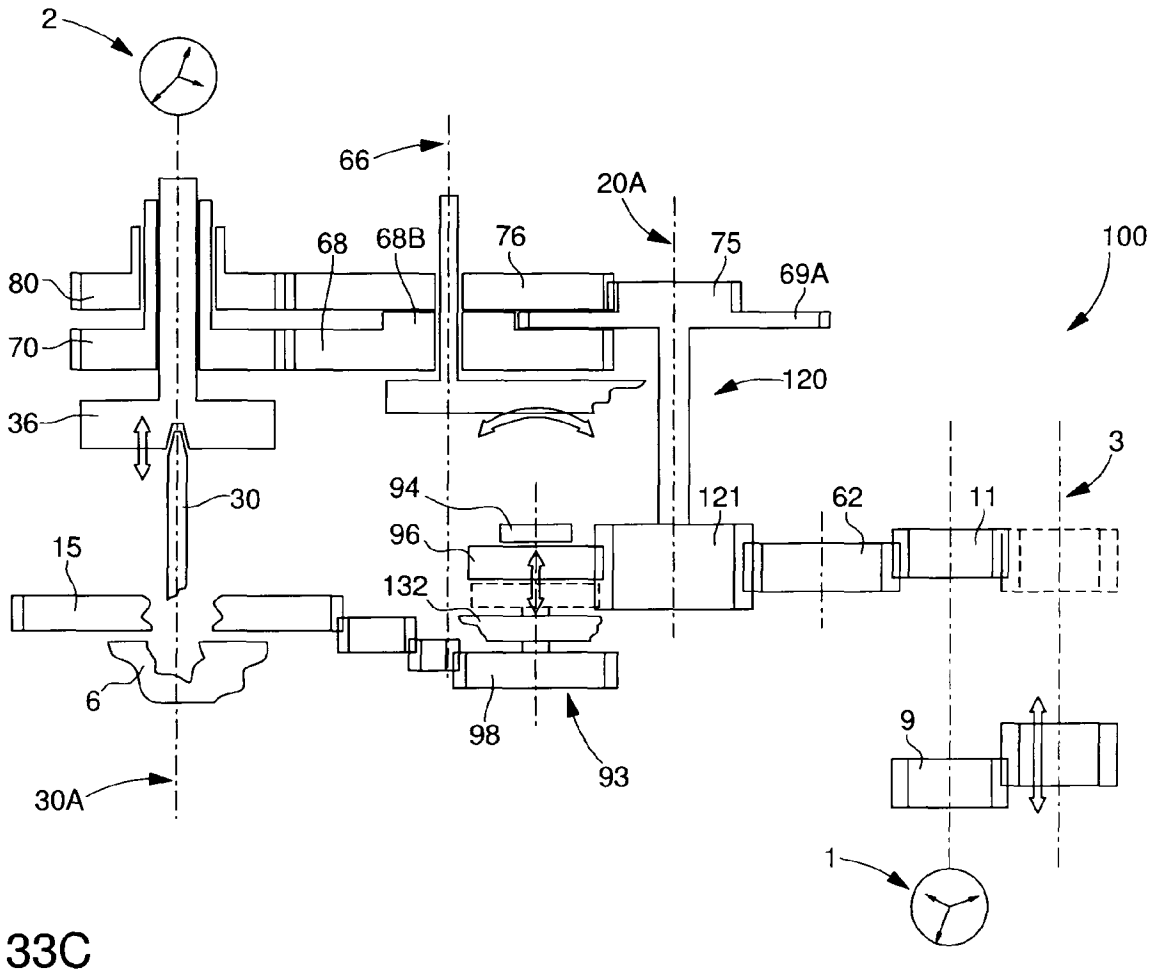
FIG. 33C shows a similar, schematic view to FIG. 21 of the kinematic chain of the second embodiment.

FIG. 33 shows inter-time zone mechanism 93 meshing with a wheel 121 of a time zone wheel set 120 comprised in mechanism 100. FIGS. 33*a* and 33B, which respectively illustrate the coupled and uncoupled positions of the inter-time zone mechanism, show that top wheel 96 always remains meshed on wheel 121. Coupling or uncoupling occurs only as regards complementary, preferably conical, shoulders, 97A and 96A.

In this second embodiment, the time zone wheel set no longer includes a friction wheel, since the coupling function is performed by the inter-time zone mechanism 93.

To hold cannon-pinion hearts 36, 70 and 80 in position, when centre secondary display 2 is stopped by another application of pressure on first push-button 4, mechanism 100 uses this inter-time zone mechanism 93, and more specifically the friction of the spring 95 thereof. The spring 95 pushes the top wheel 96 against the top flange 94, and friction against the flange generates sufficient friction to immobilise the cannon-pinion hearts, while remaining sufficiently low to be overcome by any manipulation of crown 3.

Figure 34:
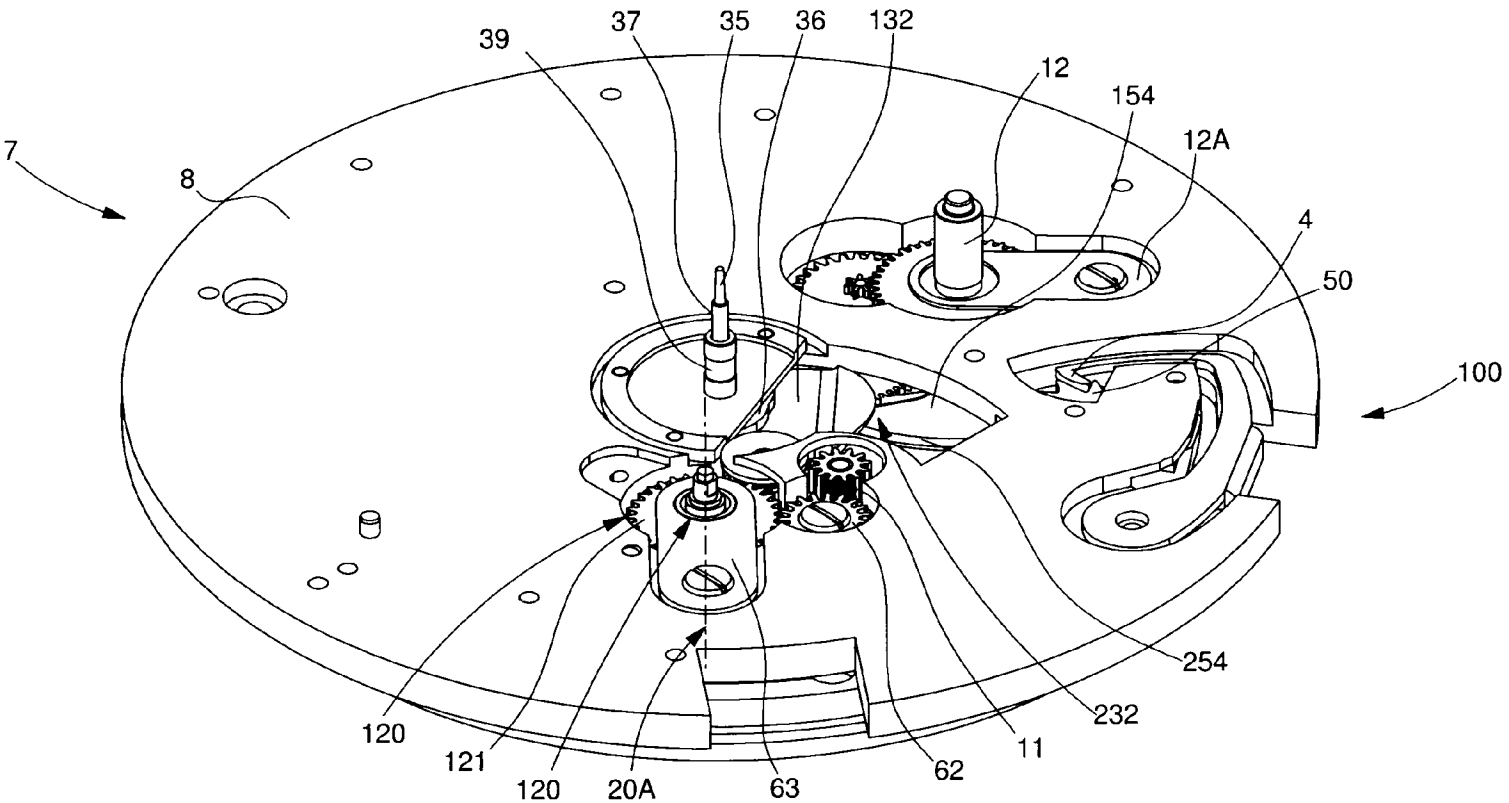

FIG. 34 shows mechanism 100 in an intermediate assembly position, underneath a bridge 39 of the chronograph arbour.

Figure 35:
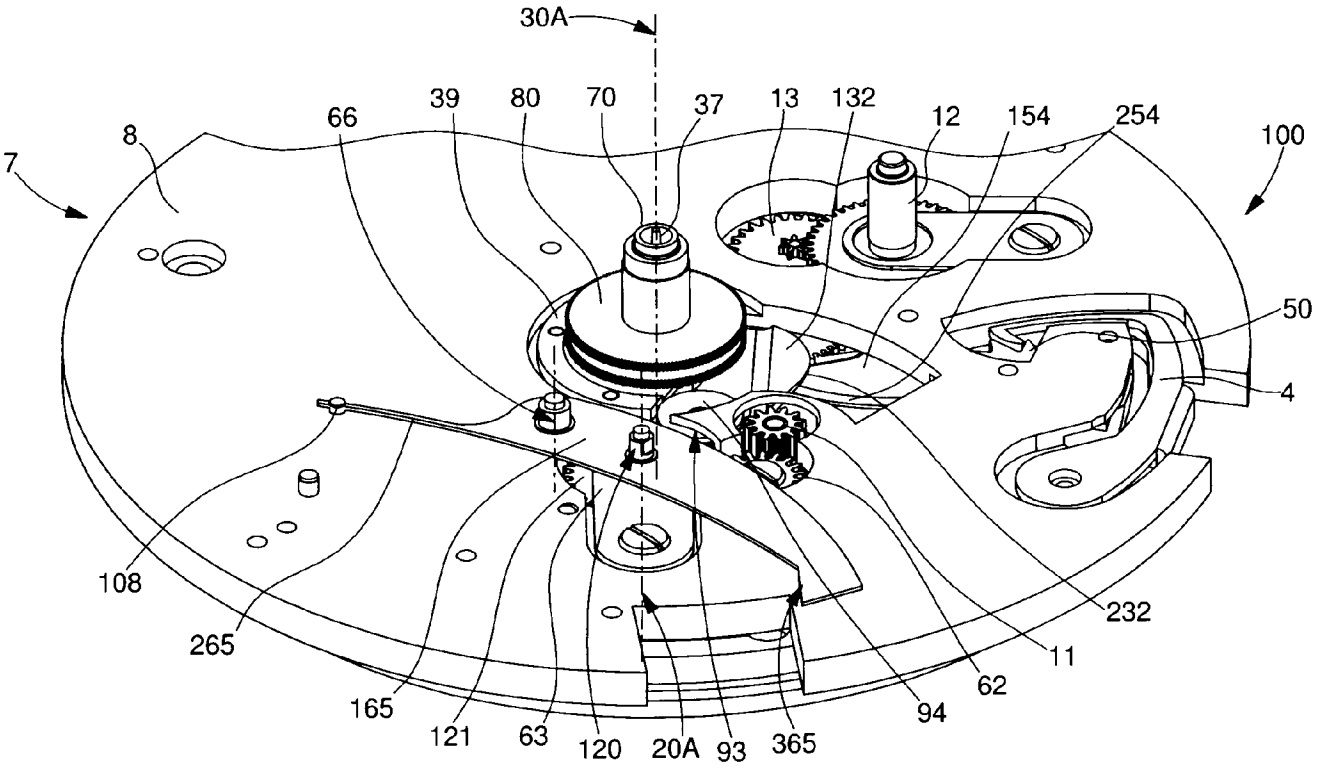

FIG. 35 shows a chronograph lever 165, which replaces second sliding gear 65 of the first embodiment, and is mounted to pivot about a pivot axis 20A of time zone wheel set 120. This chronograph lever 165 includes, at a first end, a spring arm 265 pressing against a stop member 108 comprised in additional plate 8. Between the pivot axis thereof and spring arm 265, the chronograph lever carries the stack of wheels, similar to those of the first embodiment shown in FIG. 21, which cooperate both with the time zone wheel set and with the chronograph display, and in particular the chronograph minute drive wheel 68, arranged for cooperating with toothing 72 of minute cannon-pinion heart 70, and the intermediate chronograph hour wheel 76, arranged to cooperate with toothing 82 of hour cannon-pinion heart 80 of secondary display 2.

Figure 36:
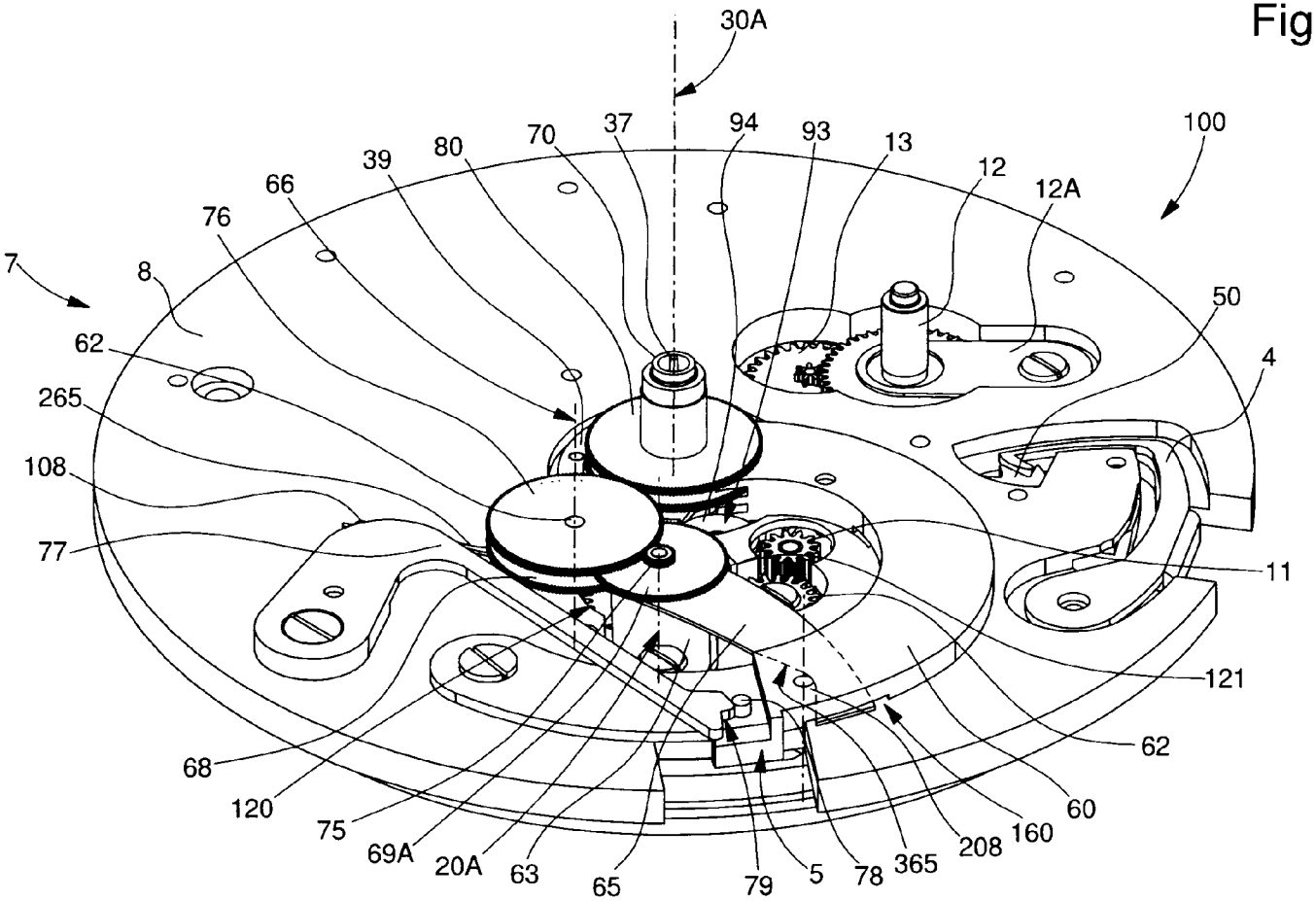

Chronograph lever 165 further includes, at a second end opposite the first end, a support face 365 arranged to cooperate in a stop arrangement with a pin 208, carried by fly-back lever 60 and seen in FIG. 36, for controlling the pivoting motion when fly-back lever 60 is made to pivot by second push-button 5. Consequently, chronograph minute drive wheel 68 is uncoupled from toothing 72 of minute cannon-pinion heart 70, and the intermediate chronograph hour wheel 76 from toothing 82 of cannon-pinion heart 80, before heart-pieces 42, 72, 82 of cannon-pinion hearts 36, 70. 80 are reset to zero, via hammers 60X, 60Y, 60Z of fly-back lever 60. The effect of releasing second push-button 5 is to move these hammers away from the heart-pieces, leaving them free to pivot, and the return of fly-back lever 60 via spring 77 returns the wheels driven by time zone wheel set 120 to mesh with the heart-pieces of the second display 2.

FIG. 36 shows mechanism 100 of the second embodiment with the complete fly-back mechanism. Fly-back lever 60 is similar to that of the first embodiment. It includes a hollow 160 to allow chronograph lever 165 to pivot.

To summarize the operation of mechanism 100 in this second embodiment, the results of various actions on crown 3, first push-button 4 and second push-button 5 on the display are set out below:

T1, crown 3 pushed in, first, S/S (stop/start) push-button 4 in the start position, no action on second push-button 5: chronograph activated;

T1, crown 3 pushed in, first, S/S push-button 4 in start position, push-button 5 activated and released: secondary display 2 reset to zero and chronograph restarts immediately. The fly-back has an instantaneous function. It cannot remain pushed in, it immediately returns to the external position;

T1, crown 3 pushed in, first, S/S push-button 4 in start position, push-button 5 held pushed in: secondary display 2 reset to zero and secondary display 2 stopped.

T1, crown 3 pushed in, first, S/S push-button 4 in stop position, no action on second push-button 5: secondary display 2 released, the three hands remain in the position in which they were uncoupled by first push-button 4;

T1, crown 3 pushed in, first, S/S push-button 4 in stop position, push-button 5 activated and released: secondary display 2 reset to zero. Once the fly-back has been released, the three hands of secondary display 2 are reset to zero and remain there;

T1, crown 3 pushed in, first, S/S push-button 4 in stop position, push-button 5 held pushed in: secondary display 2 reset to zero and secondary display 2 stopped.

in position T1 it is not possible to set the hands of either the first display 1 or second display 2.

T2, first intermediate traction, first, S/S push-button 4 in start position, no action on second push-button 5: displays 1 and 2 uncoupled. The uncoupling is not achieved via the crown, but comes from the push-button action. The secondary display 2 continues to operate and can be manipulated. The main display 1 is not affected.

T2, first intermediate traction, first, S/S push-button 4 in start position, second push-button 5 activated then released: displays 1 and 2 uncoupled. Secondary display 2 is reset to zero. The fly-back is released. The secondary display 2 continues to operate and can be manipulated to set the hands thereof. The main display 1 is not affected by the hand-setting.

T2, first intermediate traction, first, S/S push-button 4 in start position, second push-button 5 held pushed in: displays 1 and 2 uncoupled. Secondary display 2 is reset to zero. Secondary display 2 is stopped and cannot be manipulated. The main display 1 is not affected.

T2, first intermediate traction, first, S/S push-button 4 in stop position, no action on second push-button 5: displays 1 and 2 uncoupled. The secondary display 2 continues to operate and can be manipulated in both directions. The main display 1 is not affected.

T2, first intermediate traction, first, S/S push-button 4 in stop position, second push-button 5 activated then released: displays 1 and 2 uncoupled. Secondary display 2 is reset to zero. The secondary display 2 is stopped but it can be manipulated in both directions to set the hands thereof. The main display 1 is not affected.

T2, first intermediate traction, first, S/S push-button 4 in stop position, second push-button 5 held pushed in: displays 1 and 2 uncoupled. The fly-back is released. The secondary display 2 stops operating. Secondary display 2 cannot be manipulated to set the hands thereof. The main display 1 is not affected.

T3, complete traction, first, S/S (stop/start) push-button 4 in start position, no action on second push-button 5: displays 1 and 2 coupled. Possible to manipulate both displays 1 and 2 at the same time.

T3, complete traction, first, S/S push-button 4 in start position, second push-button 5 activated then released: displays 1 and 2 coupled. Secondary display 2 is reset to zero. The secondary display 2 continues to operate. The fly-back is released. Possible to manipulate both displays 1 and 2 at the same time.

T3, complete traction, first, S/S push-button 4 in start position, second push-button 5 held pushed in: displays 1 and 2 coupled. Secondary display 2 is reset to zero. Secondary display 2 is stopped. Only possible to manipulate display 1;

T3, complete traction, first, S/S push-button 4 in stop position, no action on second push-button 5: displays 1 and 2 coupled. Possible to manipulate both displays 1 and 2 at the same time.

T3, complete traction, first, S/S push-button 4 in stop position, second push-button 5 activated then released: displays 1 and 2 separated. Secondary display 2 is reset to zero. The fly-back is released. Possible to manipulate both displays 1 and 2 at the same time.

T3, complete traction, first, S/S push-button 4 in stop position, second push-button 5 held pushed in: displays 1 and 2 separated. Secondary display 2 is reset to zero. Secondary display 2 is stopped. Only possible to manipulate display 1;

It should be noted that, in position T3, if the operator only wishes to manipulate the first display, he may, with this second embodiment, hold the second fly-back push-button 5 in a pushed in position and perform a correction of the first display only.

The operator may also, if the chronograph is stopped, perform a correction of the first display only.

It can be seen that the second embodiment offers the user even more possibilities than the first embodiment, which already offers many new functions.

In a particular embodiment of the invention the first display 1 is shifted, and secondary display 2 is at the centre of the timepiece 1000. Compared to an existing movement, this configuration uses an additional mechanism of very small thickness, for example less than or equal to 1.8 mm, or can easily integrate mechanism 100 according to the invention in an existing movement 6. The reverse configuration is also possible, but less advantageous in terms of space, as is the configuration with both displays 1 and 2 off-centre.

Advantageously, mechanism 100 according to the invention does not include a braking device for secondary display 2, which is mounted to pivot freely as it is.

The invention further concerns an additional mechanism arranged to be added to a timepiece 1000 which includes a single movement 6, a first display 1 and a crown 3 for at least setting, via a motion work 13, the hands of the first display 1 in a setting position. This additional mechanism includes, assembled on an additional plate 8, an additional on demand display mechanism 100 according to any of the embodiment versions described above.

The invention particularly concerns an additional, on demand display mechanism 100, which is an additional mechanism for a timepiece with a single movement, including a dual display, wherein the first display 1 is the continuous display in normal time mode, the secondary display 2 is an additional display, in particular that of a chronograph mechanism.

The invention also concerns a multiple display module including at least one additional, on demand display mechanism 100 and/or at least one such additional mechanism, and also at least one other display operationally connected to said additional, on demand display mechanism 100 or to said additional mechanism.

The invention more generally concerns a multiple display module including at least one said additional, on demand display mechanism 100 and at least one other display operationally connected to said mechanism 100.

The invention also concerns a timepiece 1000 including at least one such additional, on demand display mechanism 100 and/or at least one such additional mechanism.

The invention particularly concerns a timepiece 1000 with a single movement, including a dual display, wherein the first display 1 is the continuous display in normal time mode, the secondary display 2 is an additional display, in particular that of a chronograph mechanism.

Naturally, this timepiece may include movements other than movement 6, but the latter is unique for the dual display set out in this description.

In short, the invention proposes two embodiments to overcome the problem of making a dual display with separate control of each of the display at any time. In each of these two embodiments, coupling/uncoupling means is inserted between the existing timepiece movement, to which a first display is connected, whose hands may be set by a crown in a certain position, and also a second display, whose hands may be set independently of the first display by a crown in a different position.

This uncoupling/coupling means is formed in the first embodiment by a friction wheel and in the second embodiment by a conical coupling.

In both of these embodiments, mechanism 100 according to the invention does not have a brake, unlike the usual chronograph mechanisms, particularly those provided with a flyback function, which is a great advantage in terms of complexity, the number of components, compactness and available energy.

What is claimed is:

1. A mechanism for an additional secondary display of a first physical quantity, which includes a first push-button arranged for activating control means of first means for coupling/uncoupling said secondary display to or from a movement including a first display, wherein said secondary display includes a pivoting first physical quantity cannon-pinion heart, the coupling/uncoupling means of which is arranged for controlling the coupling/uncoupling to or from said movement, a second zero reset push-button for said secondary display for resetting said secondary display to zero by uncoupling said coupling/uncoupling means, and by returning said cannon-pinion heart to the original position thereof, wherein said mechanism includes second coupling/uncoupling control means, which includes either a pivoting time zone wheel set, including a friction wheel meshing with said movement and a time zone wheel, which, when said time zone wheel set is in the coupling position, directly or indirectly drives a second physical quantity cannon-pinion heart, and/or a third physical quantity cannon-pinion heart, said friction wheel and time zone wheel being coaxial and able to cooperate with each other via a friction coupling; or which includes an inter-time zone mechanism, carried by a control lever comprised in said control means of the first coupling/uncoupling means, said inter-time zone mechanism being a coupling mechanism and including a bottom wheel directly meshing with said movement, and a top wheel, which, when said inter-time zone mechanism is in the coupling position, is arranged for directly or indirectly driving at least said second physical quantity cannon-pinion heart, and/or said third physical quantity cannon-pinion heart.

2. The mechanism according to claim 1, wherein said mechanism forms an additional, on demand display mechanism forming at least said secondary display of at least a first physical quantity, for said movement for measuring and/or generating at least one physical quantity including said first display of at least one physical quantity, wherein said mechanism includes:

said first start-stop push-button, arranged for activating control means of first coupling/uncoupling means arranged for allowing or preventing the coupling of at least one display indicator of said secondary display to said movement;

said second push-button, arranged for activating means controlling the zero reset of said secondary display;

and, for driving a display indicator of said first physical quantity, said secondary display including said first physical quantity cannon-pinion heart which has no toothing and is free to pivot about a pivot axis, and which includes a peripheral heart-piece arranged for cooperating with a hammer comprised in said mechanism for returning said heart-piece to the original position thereof;

said first coupling/uncoupling control means controlling the coupling or uncoupling respectively of said first physical quantity cannon-pinion heart relative to said movement;

said second push-button controlling the zero reset of said secondary display, by controlling the both uncoupling said first coupling/uncoupling control means, and by returning said heart-piece of said first physical quantity cannon-pinion heart to the original position thereof, and said secondary display including, for driving the display indicators of at least a second physical quantity and/or a third physical quantity, at least said second physical quantity cannon-pinion heart, and/or said third physical quantity cannon-pinion heart which are free to pivot independently of each other, and which respectively include peripheral heart-pieces each arranged to cooperate with a hammer comprised in said mechanism in order to return said heart-piece to the original position thereof;

said first start-stop push-button controlling second coupling/uncoupling control means, arranged for allowing or preventing the coupling of at least said second physical quantity cannon-pinion heart and/or said third physical quantity cannon-pinion heart to said movement;

and said second push-button controlling the zero reset of said secondary display, by uncoupling said second coupling/uncoupling control means, and returning said heart-pieces to the original position thereof.

3. The mechanism according to claim 1, wherein said first coupling/uncoupling means is formed by a combination of a conical bore, respectively a cone, comprised in the pivot axis of said first physical quantity cannon-pinion, and a cone, respectively a conical bore, comprised in said movement, or connected thereto.

4. The mechanism according to claim 1, wherein said first physical quantity cannon-pinion heart, and at least a second physical quantity cannon-pinion heart and/or a third physical quantity cannon-pinion heart are mounted coaxial to an axis directly connected to said movement or comprised therein.

5. The mechanism according to claim 1, wherein said secondary display includes, for driving the display indicators of at least a second physical quantity and/or a third physical quantity, at least said second physical quantity cannon-pinion heart, and/or said third physical quantity cannon-pinion heart which pivot independently of each other, and which respectively include peripheral heart-pieces each arranged to cooperate with a hammer comprised in said mechanism in order to return said heart-piece to an original position, and in that said second push-button, when pushed in, controls the movement of a fly-back lever, to rest on said heart-pieces and return said heart-pieces to the original position thereof.

6. The mechanism according to claim 1, wherein said secondary display is mounted to pivot freely.

7. The mechanism according to claim 1, wherein it is a dual display mechanism for a timepiece, which includes a first continuous display in normal time mode, and a movement and a crown for adjusting, via a motion work, at least the hand-setting of said first display, and wherein said first physical quantity cannon-pinion heart is a seconds cannon-pinion heart.

8. The mechanism according to claim 7, wherein said second physical quantity cannon-pinion heart is a minute cannon-pinion heart, and said third physical quantity cannon-pinion heart is an hour cannon-pinion heart.

9. The mechanism according to claim 7, wherein said second coupling/uncoupling control means includes a time zone wheel set, and wherein said crown is arranged to occupy, upon action by the user, a position for setting said secondary display, in which said time zone wheel cooperates, via an intermediate motion work wheel set, with said motion work.

10. The mechanism according to claim 7, wherein said first, start-stop push-button includes or directly drives a tooth, which activates control means of first coupling/uncoupling means, formed by a toothed top wheel, comprised in a column wheel, and which is secured to a coaxial toothed bottom wheel, which is arranged for cooperating with a first support surface of a sliding gear that pivots about an arbour, said sliding gear including a second support surface which cooperates with an edge of a stop lever, said stop lever pivoting about an arbour and including a recess provided with a chamfer, arranged for cooperating with a ramp comprised in said seconds cannon-pinion heart for raising or lowering said heart.

11. The mechanism according to claim 10, wherein said second physical quantity cannon-pinion heart is a minute cannon-pinion heart, and said third physical quantity cannon-pinion heart is an hour cannon-pinion heart, and wherein said stop lever is returned towards said sliding gear by a lever spring, and includes a lever notch which is arranged for driving an arbour, which carries said intermediate minute wheel set for the meshing thereof with said minute cannon-pinion heart, when said first coupling/uncoupling control means is in the coupling position, said intermediate minute wheel being free to pivot about said arbour.

12. The mechanism according to claim 7, wherein said second coupling/uncoupling control means includes a friction wheel set and wherein said friction wheel rests, via a friction mechanism in the form of a clamp and/or a friction surface, on the bottom arbour of said time zone wheel set and/or on a bottom surface comprised in said time zone wheel in the median position of said time zone wheel set, the function of the friction wheel being to uncouple said time zone wheel from said friction wheel so as to form an additional cannon-pinion which can be uncoupled to operate said secondary display alone, the friction being controlled by an intermediate wheel which meshes with said time zone wheel and which, in turn, is or is not operated by a set-hands extension pinion extending a set-hands pinion, arranged for cooperating with said movement, or comprised in said movement.

13. The mechanism according to claim 8, wherein said secondary display includes, for driving the display indicators of at least a second physical quantity and/or a third physical quantity, at least said second physical quantity cannon-pinion heart, and/or said third physical quantity cannon-pinion heart which pivot independently of each other, and which respectively include peripheral heart-pieces each arranged to cooperate with a hammer comprised in said mechanism in order to return said heart-piece to an original position, and in that said second push-button, when pushed in, controls the movement of a fly-back lever, to rest on said heart-pieces and return said heart-pieces to the original position thereof, and wherein said second, zero reset push-button drives a fly-back lever, to rest on said seconds cannon-pinion heart and on said minute cannon-pinion heart to return said hearts to the original position thereof, a fly-back spring being arranged to cooperate or not cooperate, via a notch comprised in said spring with a pion comprised in said fly-back lever, said spring tending to exert on said fly-back lever a force that tends to move said lever away from said seconds cannon-pinion heart and said minute cannon-pinion heart.

14. The mechanism according to claim 7, wherein said first physical quantity cannon-pinion heart, and at least a second physical quantity cannon-pinion heart and/or a third physical quantity cannon-pinion heart are mounted coaxial to an axis directly connected to said movement or comprised therein, and wherein said second coupling/uncoupling control means includes an inter-time zone mechanism and wherein said first, start-stop push-button includes or directly drives a tooth, which activates control means of first coupling/uncoupling means, formed by a toothed top wheel, comprised in a column wheel, and which is secured to a coaxial toothed bottom wheel, which is arranged for cooperating with a first support surface of a sliding gear, including, at the periphery thereof, a chamfered edge arranged for cooperating with a control lever which includes a sloping edge, which is arranged for cooperating with said chamfered edge of said first sliding gear, the pivoting motion of which causes a movement of translation of said control lever, parallel to said axis, upwards or downwards depending upon the direction of pivoting of said first sliding gear, for raising or lowering said seconds cannon-pinion heart.

15. The mechanism according to claim 7, wherein said first physical quantity cannon pinion heart, and at least a second physical quantity cannon-pinion heart and/or a third physical quantity cannon-pinion heart are mounted coaxial to an axis directly connected to said movement or comprised therein, and wherein said second coupling/uncoupling control means includes an inter-time zone mechanism and wherein said inter-time zone mechanism includes, on either side of said control lever, a top flange and said bottom wheel secured to each other via a hub and also, between said control lever and said top flange, said top wheel which is axially mobile relative to said hub while always remaining in mesh with a wheel of a time zone wheel set comprised in said mechanism, the coupling or uncoupling of said inter-time zone wheel set occurring on a shoulder comprised in said hub and which is arranged for cooperating with a complementary slope comprised in said top wheel in a coupling position in which said top wheel is pressed onto said hub, via the action of a spring for synchronisation thereof with said bottom wheel, the uncoupling position, resulting from the engagement of said first sliding gear underneath said control lever, and the lifting of said lever by the first sliding gear, raising said top wheel towards said top flange and uncoupling said top wheel from said bottom wheel.

16. The mechanism according to claim 8, wherein said first physical quantity cannon-pinion heart, and at least a second physical quantity cannon-pinion heart and/or a third physical quantity cannon-pinion heart are mounted coaxial to an axis directly connected to said movement or comprised therein, and wherein it is a dual display mechanism for a timepiece, which includes a first continuous display in normal time mode, and a movement and a crown for adjusting, via a motion work, at least the hand-setting of said first display, and wherein said first physical quantity cannon-pinion heart is a seconds cannon-pinion heart, and wherein said second coupling/uncoupling control means includes an inter-time zone mechanism and it includes a chronograph lever pivotably mounted about the pivot axis of a time zone wheel set, and which includes, at a first end, a spring arm fixed to the structure of said mechanism, and which carries, between the pivot axis and said spring arm, a stack of wheels, which cooperate both with said time zone wheel set and with the secondary display, and in particular a chronograph minute drive wheel arranged for cooperating with a toothing of said minute cannon-pinion heart, and an intermediate chronograph hour wheel arranged for cooperating with a toothing of said hour cannon-pinion heart of said secondary display.

17. The mechanism according to claim 16, wherein said chronograph lever includes, at a second end opposite to the first end, a support face arranged for cooperating in a stop arrangement with a pin, carried by a fly-back lever for controlling the pivoting thereof when said fly-back lever is made to pivot by said second push-button, for uncoupling said chronograph minute drive wheel from said toothing of said minute cannon-pinion heart, and said intermediate chronograph hour wheel from said toothing of said hour cannon-pinion heart, prior to resetting said heart-pieces to zero by hammers comprised in said fly-back lever, the release of said second push-button moving said hammers away from said heart-pieces and leaving the said heart-pieces free to pivot, and the return of said fly-back lever by a return spring bringing the wheels driven by said time zone wheel set back into mesh with the heart-pieces of said second display.

18. The mechanism according to claim 1, wherein said first display is shifted, and said secondary display is at the centre of a timepiece and wherein said mechanism forms, with respect to an existing movement, an additional mechanism with a thickness of less than or equal to 1.8 mm.

19. An additional mechanism comprising a mechanism for the additional secondary display according to claim 1, said additional mechanism being arranged to be added to a timepiece including said movement, with said first display and a crown for adjusting, via a motion work, at least the hand-setting of said first display in a setting position, wherein said mechanism for the additional secondary display is assembled on an additional plate.

20. A multiple display module comprising the mechanism according to claim 1.

21. A timepiece comprising the mechanism according to claim 1.

* * * * *